US006862961B2

(12) United States Patent
Winkler

(10) Patent No.: US 6,862,961 B2
(45) Date of Patent: Mar. 8, 2005

(54) LOCKING PLIERS TOOL WITH AUTOMATIC JAW GAP ADJUSTMENT AND ADJUSTABLE CLAMPING FORCE CAPABILITY

(76) Inventor: John Andrew Winkler, 2141 N. Nightshade Dr., Tucson, AZ (US) 85715

( * ) Notice: Subject to any disclaimer, the term of this patent is extended or adjusted under 35 U.S.C. 154(b) by 0 days.

(21) Appl. No.: 10/252,648

(22) Filed: Sep. 23, 2002

(65) Prior Publication Data

US 2004/0055429 A1 Mar. 25, 2004

(51) Int. Cl.[7] ..... B25B 7/12

(52) U.S. Cl. ..... 81/367; 81/355; 81/318; 81/362

(58) Field of Search ..... 81/367–383, 383.5, 81/384–386, 313, 318, 339, 342, 347, 355, 356, 362, 364–366, 415, 387, 300, 315, 319–324

(56) References Cited

U.S. PATENT DOCUMENTS 2,643,567 A * 6/1953 Johnson ..... 81/352
2,988,941 A * 6/1961 Ortman ..... 81/344
3,379,079 A * 4/1968 Cutter ..... 81/367
4,499,797 A 2/1985 Wilson
5,289,746 A * 3/1994 Finn ..... 81/356
5,528,965 A * 6/1996 Finn ..... 81/356
6,082,231 A * 7/2000 Tsai ..... 81/364
6,199,458 B1 3/2001 Wrigley et al.
6,279,431 B1 8/2001 Seber et al.
6,314,843 B1 11/2001 Wiebe et al.
6,378,404 B1 4/2002 Bally et al.
6,450,070 B1 9/2002 Winkler et al.

* cited by examiner

*Primary Examiner*—David B. Thomas

(57) ABSTRACT

A locking pliers tool which combines a self-locking, frictional brake, gap setting means to set jaw gap size automatically when clamping onto a workpiece, and an over-center linkage clamping means to securely clamp the workpiece in between the opposing tool jaws, and an adjustment means for setting the clamping force to be exerted onto the gripped workpiece.

20 Claims, 23 Drawing Sheets

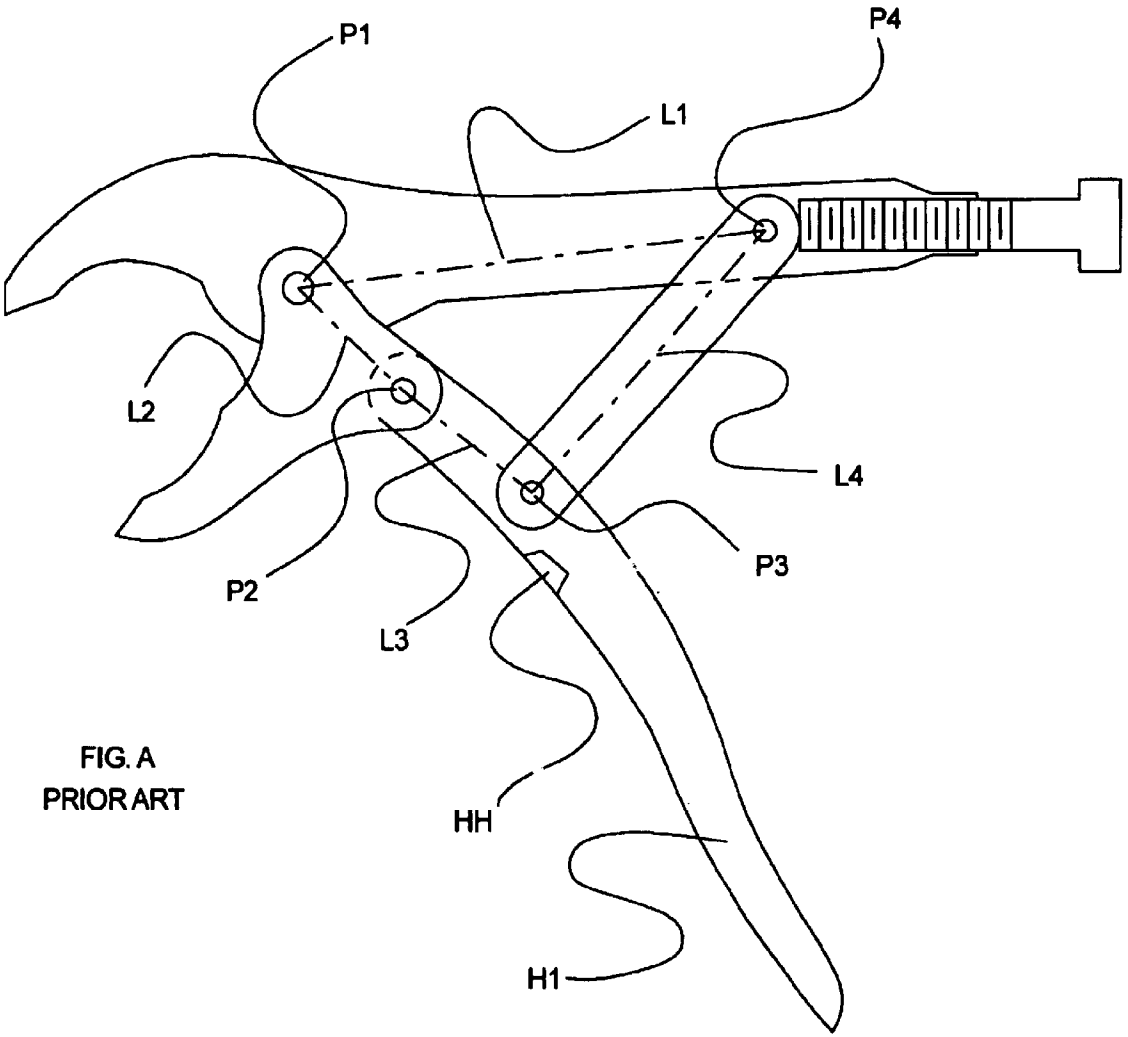
FIG. A
PRIOR ART

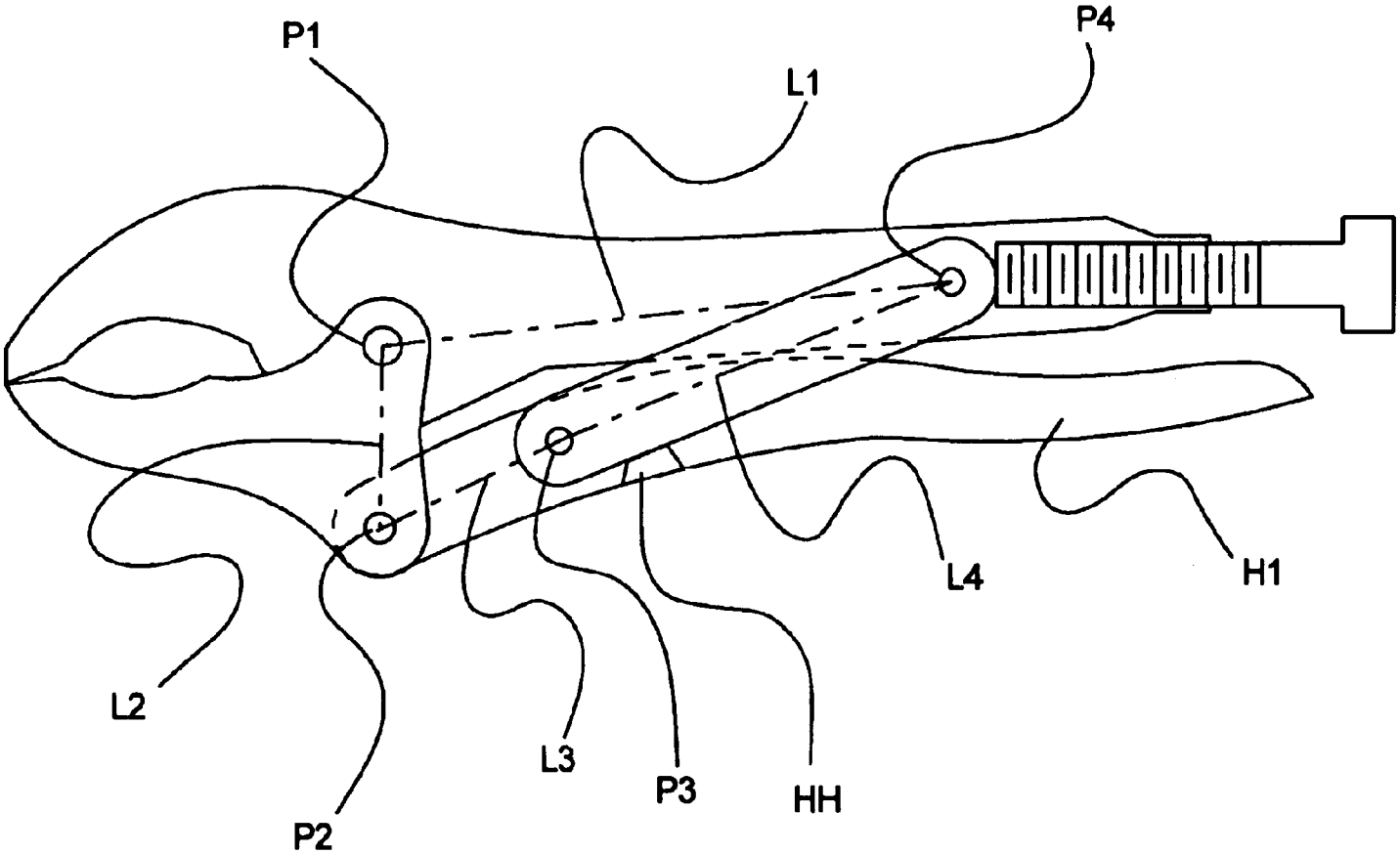
FIG. B
PRIOR ART

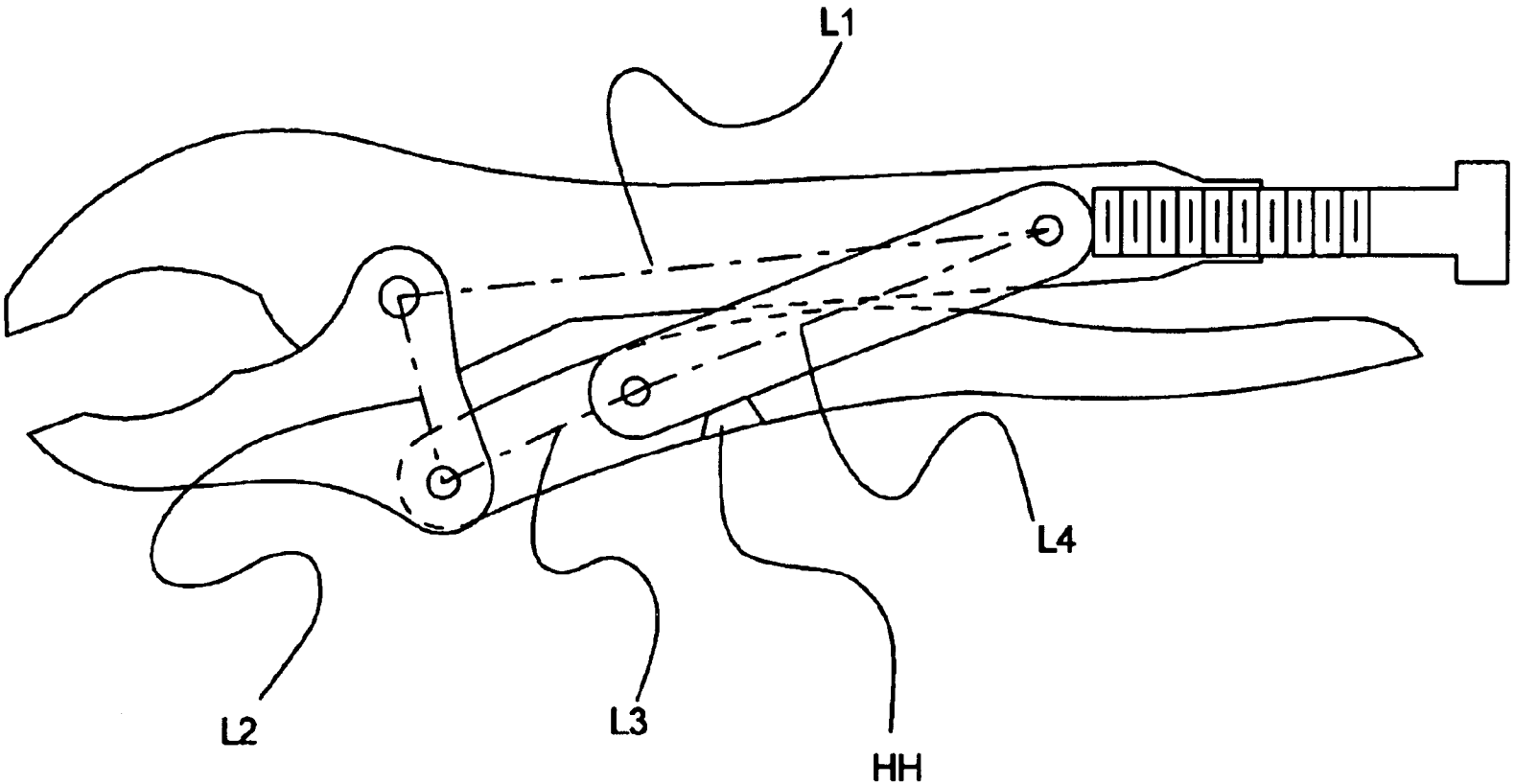
FIG. C
PRIOR ART

LOCKING PLIERS TOOL WITH AUTOMATIC JAW GAP ADJUSTMENT AND ADJUSTABLE CLAMPING FORCE CAPABILITY

FIELD OF THE INVENTION

This invention relates to the field of portable hand tools known as "locking pliers", which allow adjustment of a set of opposable jaws pivotally fastened to one another, and are able to clamp and restrain a workpiece of variable size and geometry without continuous gripping effort from the operator.

PRIOR ART

The high workpiece clamping force, characteristic of locking pliers, is achieved by the actuation of an over-center linkage mechanism. The over-center linkage is a special design of the classic four-bar linkage found in use around the world. Prior art for a locking pliers design is shown in FIG. A. A fixed member L1 is designed in some fashion to be one of the handles of the tool which has two pivot points about which the second member L2 and the fourth link member L4 will pivot. The third member of the four-bar linkage is L3 and is typically integral to the second handle H1 of the tool. Link members L3 and L4 function as the over-center linkage of the tool. Regardless of the ergonomic details of each link in the design, the functioning link portions of each member are the lengths shown with phantom lines in the figure. The included angle between link L3 and link L4 when the tool is not gripped on a workpiece is at some angle preferably more than 90 degrees but certainly less than 180 degrees. The tool aggressively "locks" onto a workpiece when the link members L3 and L4 are rotated relative to each other to cause the included angle between the two links to become more than 180 degrees. Through the use of hardstop features built into the tool, the tool essentially has two linkage positions which are the release position and the clamp position. FIG. A shows the locking pliers tool in the release position where the included angle between L3 and L4 is less than 180 degrees. FIG. B shows the locking pliers tool in the clamp position where the angle between link members L3 and L4 is more than 180 degrees, preferably about 185 degrees. Through the use of a hardstop HH in the design, the link members would be prohibited from rotating any more than the angle achieved in the clamp position, which is 185 degrees in this example.

As a force diagram of the link members would show, compressive forces acting along links L3 and L4 drive the compressively loaded links against the hardstop feature of the tool because the links have passed through an included angle of 180 degrees. The link members cannot reverse the direction of rotation on their own and so the tool remains locked onto the workpiece held within the tool jaws as the links remain braced against the hardstop feature. When the user grips the tool to close the handles together about a workpiece, the distance between link pivot points P2 and P4 increases as the relative rotation of link members L3 and L4 changes from a release position to a clamp position as discussed. As shown in FIG. A, link L2 of the four-bar linkage is integral to the clamping jaw of the locking pliers tool. By comparing the orientation of link L2 between FIG. A and FIG. B, it can be seen that the link L2 rotates about fixed point P1 as the handles are closed together. This rotation closes the gap between the jaws of the tool to cause the tool to clamp onto a workpiece placed between the tool jaws. Ideally, the jaws of the tool first contact the workpiece as link members L3 and L4 have an included angle varying between 170 to almost 180 degrees, depending on the preferred magnitude of the clamping force exerted against the workpiece. The jaws begin to aggressively clamp onto the workpiece as the user further closes the handles after initial workpiece contact, forcing L3 and L4 to rotate to the clamp position and forcing the clamping jaw and link L2, as a link and jaw of unitary construction, to rotate and aggressively clamp the workpiece between the rotatable clamping jaw and the fixed jaw of the tool.

The difficulty with the prior art is that the opening between the tool jaws when in the clamp position must be carefully adjusted to the size of the workpiece being gripped and this adjustment must be done by the user whenever a new workpiece differs in size from the workpiece previously gripped. This adjustment is done by changing the length of the link member L1. In the prior art a thumbscrew protruding from the end of the fixed handle is used to change the length of link member L1 to consequently vary the size of the clamp position gap between the tool jaws. FIG. C shows an example of the prior art with the thumbscrew of the tool backed out of the fixed handle causing the link L1 to become elongated and consequently opening the jaw gap between the tool jaws. The prior art has typically taught that the pivot P4 traverses a slot in the fixed handle of the tool so that the pivot travels along the length of the slot as the thumbscrews drives in and out of the fixed handle of the tool. The user can refine the clamping force exerted on the workpiece by further careful adjustment of the thumbscrew to finely adjust the length of link L1. While functional, this is a very labor intensive operation requiring two handed adjustment of the tool and causes difficulty if the user additionally wishes to hold onto the workpiece with a hand while trying to adjust the thumbscrew of the locking pliers tool.

Previous designs of locking pliers tools have typically had some variation of the classic over-center linkage mechanism described above such as the Vise-Grip® design wherein a thumbscrew at the end of a fixed handle adjusts the gap between the opposing jaw faces. The thumbscrew changes the length of link L1 and the clamp position results in an included angle of about 185 degrees between links L3 and L4. This design has proven itself functional for decades but has always had the drawback that any thumbscrew adjustment of the tool requires two hands. This leaves the solo user with no hands available to hold onto a workpiece during thumbscrew adjustment. Attempts to correct this deficiency have lead to single-hand adjustment designs such as those taught in U.S. Pat. No. 4,499,797, U.S. Pat. No. 6,199,458, U.S. Pat. No. 6,279,431, U.S. Pat. No. 6,314,843, U.S. Pat. No. 6,378,404, and U.S. Pat. No. 6,450,070.

BRIEF SUMMARY OF THE INVENTION

A highly desired design of a locking pliers tool would allow the user to fully open the jaws while still keeping the fingers gripped about both handles of the pliers tool. Further, the highly desired design would also automatically adjust the gap between the jaws to the size of the workpiece as the user closes the hand grip and would apply a repeatable, user-selected clamping force to the workpiece regardless of the size of the workpiece. The invented tool is designed to be one handed in operation, allowing the user to open the unclamped jaws completely by simply relaxing the hand grip, and to achieve the correct jaw opening setting simply by squeezing the handles together. Once the jaws have contacted the workpiece, a self-braking gap setting means integrated into one of the jaws prevents the jaws from opening back up while the workpiece is gripped. At the same time that the jaws contact the workpiece and set the jaw separation gap, an over-center linkage mechanism integrated into the other jaw begins to actuate which magnifies the gripping force of the operator to securely clamp onto the workpiece with a user-selected clamping force.

FIGS. A, B, and C illustrate prior art and include a legend labeled "Prior Art" to clarify this.

DETAILED DESCRIPTION OF THE INVENTION

Figure 1:
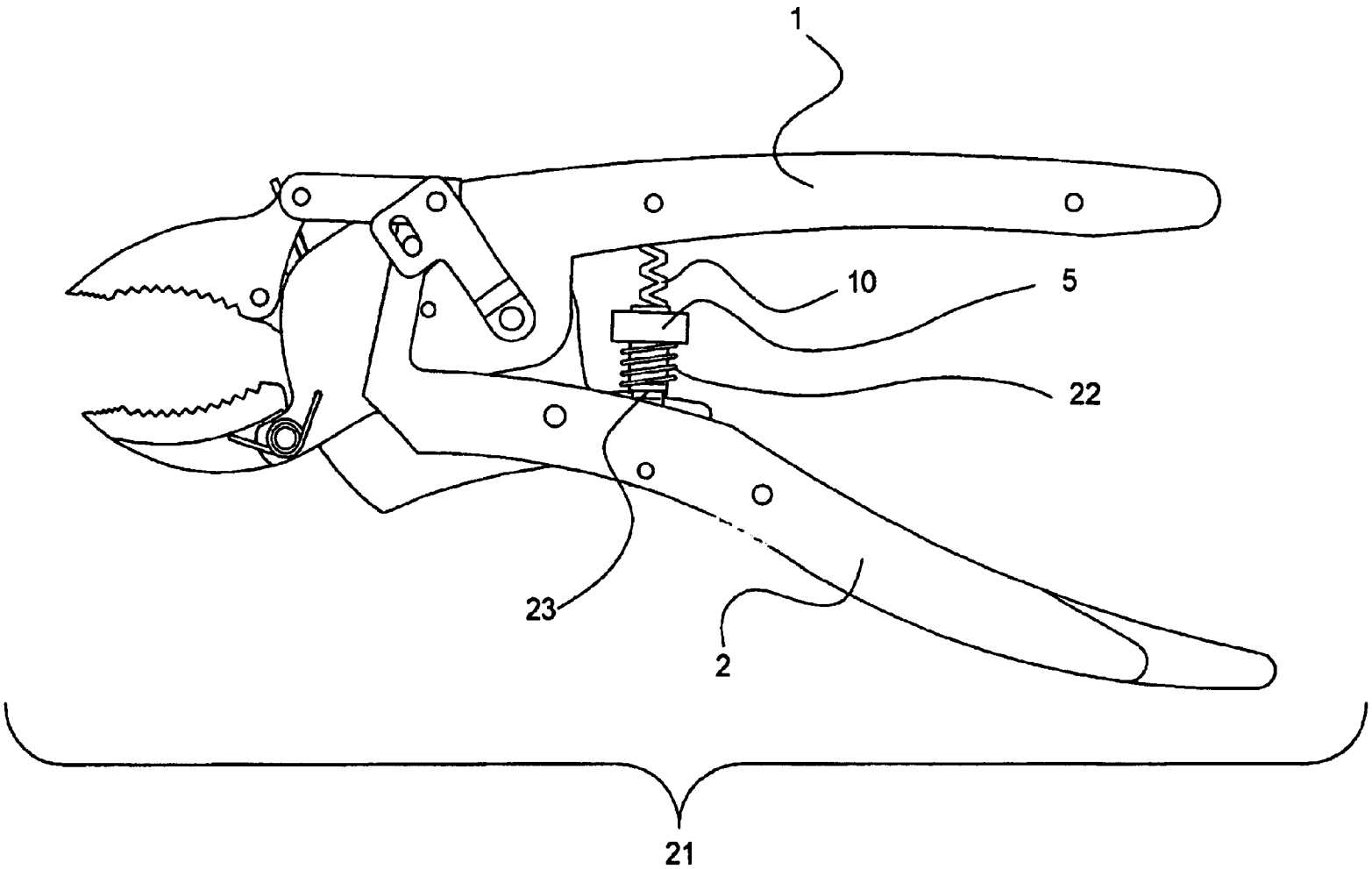
FIG. 1 shows the locking pliers tool in a plan view.

In the figures, similar reference numbers denote similar elements throughout the several views. Shown in FIG. 1 is the disclosed invention, a locking pliers tool 21, able to be held in the hand of an operator. A handle spring 10 pushes the handles 1 and 2 of the tool apart against the grip of the operator as the palm and fingers grasp around the handles of the tool. The handle spring opens the tool jaws to their maximum separation distance by pushing the handles apart As the operator closes the hand grip on the handles, the opposing jaws close their separation gap, enabling the operator to grip onto a workpiece. Each jaw performs a separate operation when the jaws come into contact with the workpiece.

Figure 1A:
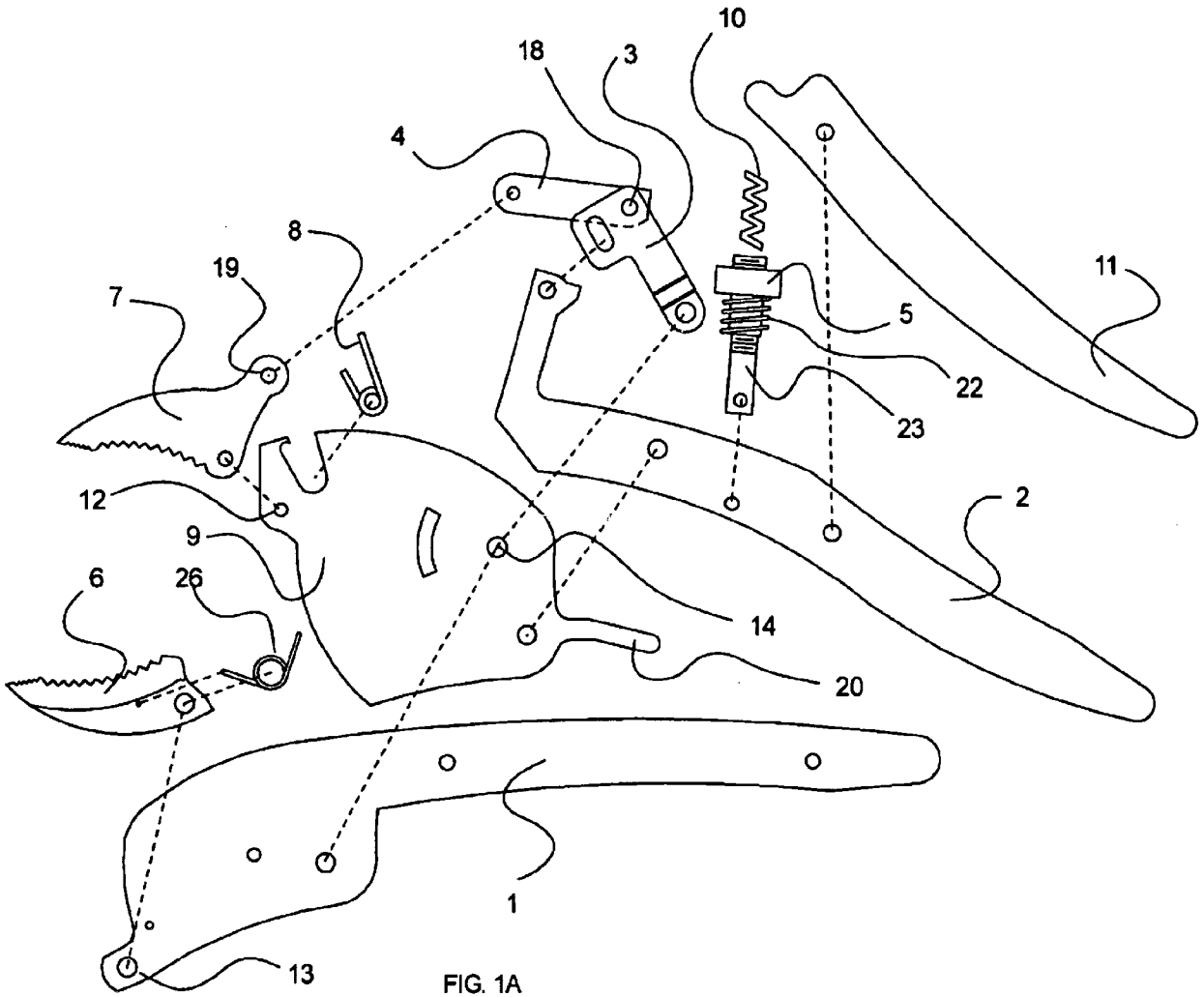
FIG. 1*a* shows an exploded plan view of the tool components for identification clarity.

Shown in FIG. 1*a* is an exploded view of the components which make up the locking pliers assembly. The brake handle 1, the clamp handle 2 and the clamping jaw 7 are all hingedly connected to the main tool body 9. The braking jaw 6 rotatably pins to the brake handle 1. When unengaged, its orientation relative to the brake handle is maintained by a brake pad lifting spring 26. An over-center linkage consists of the slotted link 3 and the clamp link 4. The end of the slotted link pins to the main tool body at the brake handle pivot 14, which serves as the first fixed point for the over-center linkage. The end of the clamp link 4 pins to the clamping jaw 7 at the link-to-jaw pivot 19. As better illustrated in FIG. 9, the two links are pinned to each other at the over-center linkage pin joint 18. An adjustment screw 23 and adjustment thumbwheel 5 allow the user to control the force that will be exerted by the linkage when clamping a workpiece between the tool jaws.

Figure 1B:
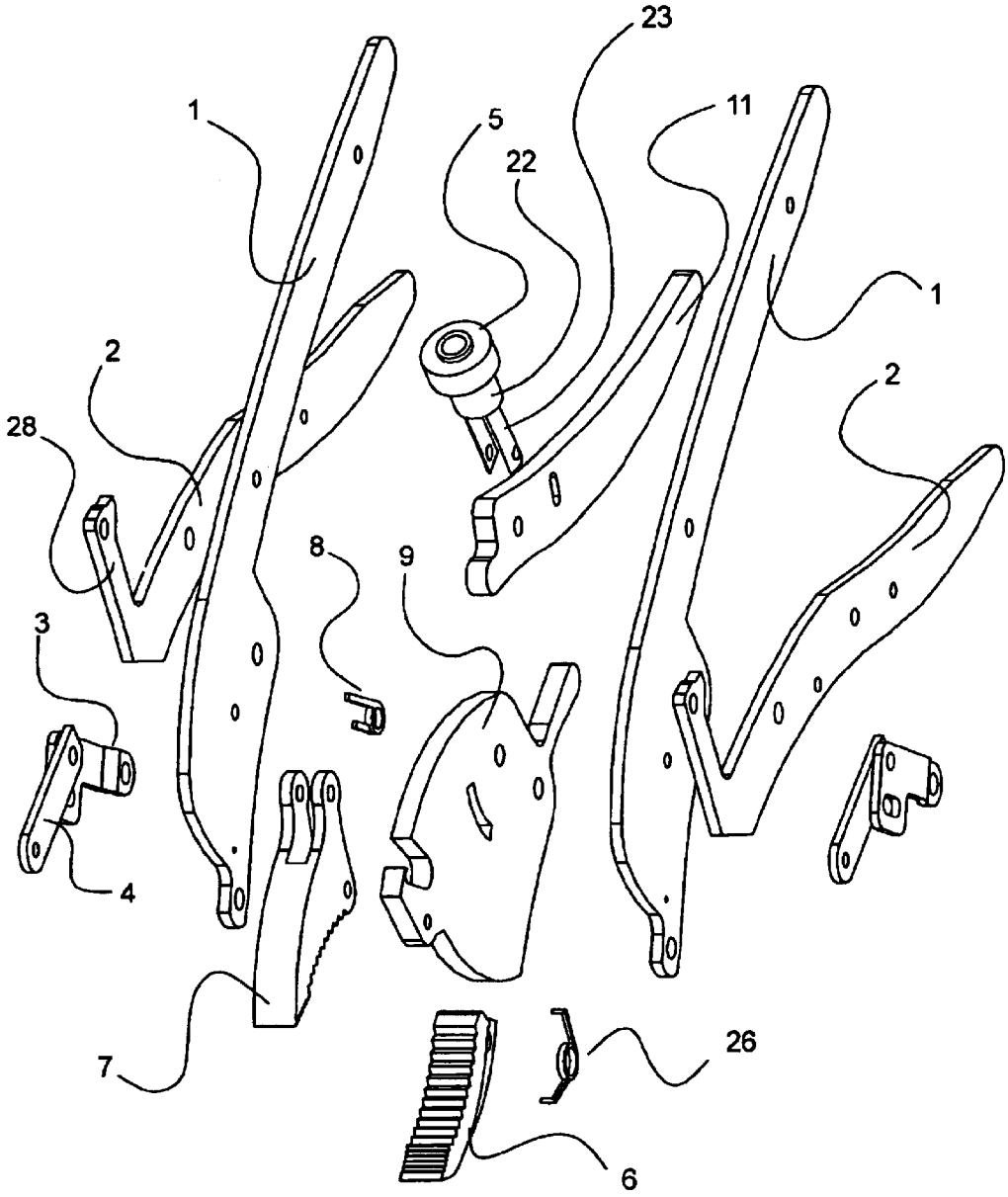
FIG. 1*b* shows an isometric exploded assembly view to assist assembly comprehension.

FIG. 1*b* shows an exploded assembly view of the locking pliers tool. Shown in FIG. 1*a*, but not shown in FIG. 1*b* for purposes of illustration clarity, is the handle spring 10.

Figure 2:
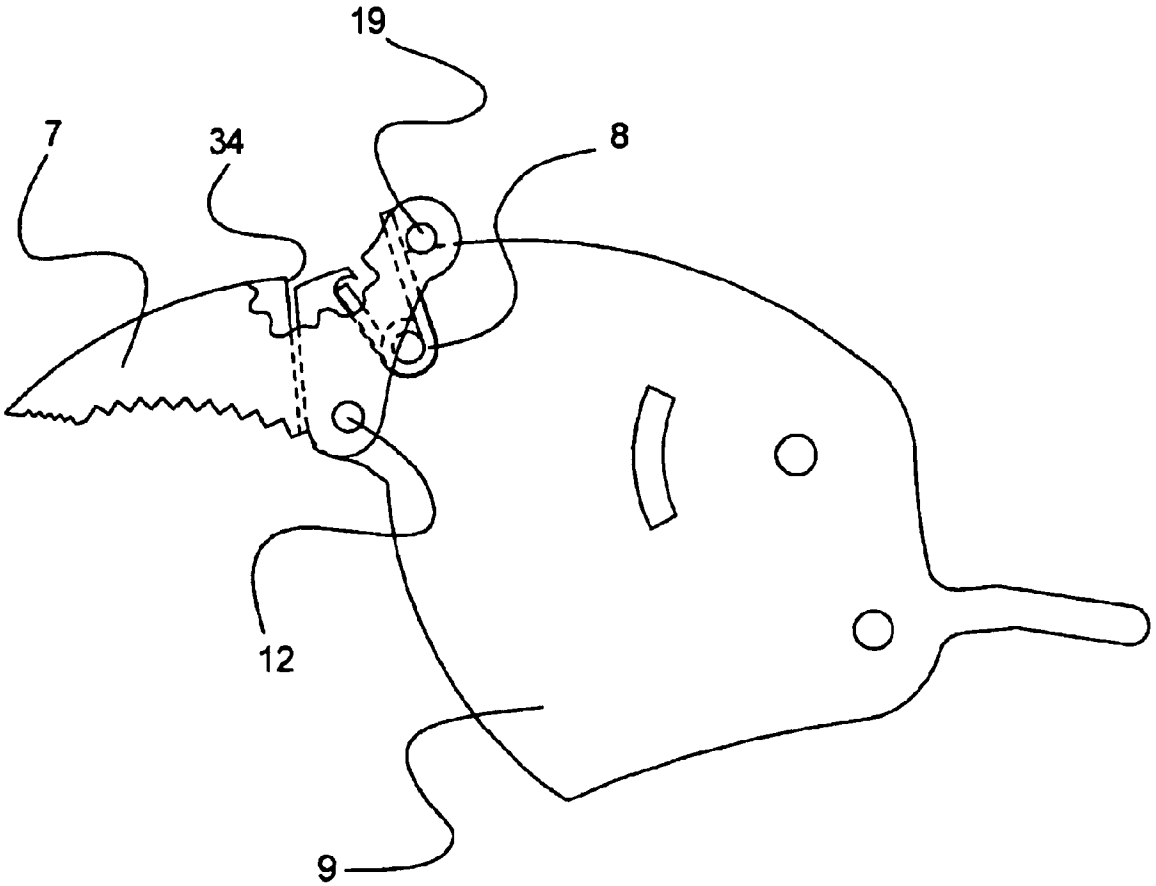
FIG. 2 shows the assembly of the clamping jaw to the main tool body.

Shown in FIG. 2 is the attachment of the clamping jaw 7 to the main tool body 9. The clamping jaw attaches, or hingedly connects, to the main tool body via a clamping jaw pivot pin 12 which allows the jaw to rotate relative to the main tool body. The clamping jaw pivot pin also serves as the second fixed point on the main tool body for the four-bar over-center linkage. The main tool body is the fixed link portion of the four-bar over-center linkage and the other link portions rotate relative to the main pliers body. A retracting spring 8 is located within a pocket of the main tool body. The retracting spring exerts a force between the main tool body and the pin located at the link-to-jaw pivot 19 of the clamping jaw to urge the clamping jaw to rotate away from the mating brake actuating jaw shown in FIG. 1*a* and described later. The relation between the retracting spring, the clamping jaw and the main tool body is engineered so that the retracting spring urges the clamping jaw to rotatably retract to a location wherein the clamping jaw hardstop 34 is separated from a contacting surface of the main tool body by an engineered gap distance which is small. The hardstop 34 is shown in the cutaway portion of FIG. 2. This engineered gap permits rotary motion of the clamping jaw to retract the jaw away from the workpiece when the user is trying to free the workpiece from the jaws. Freeing the workpiece from the jaws will also be discussed later.

Figure 3:
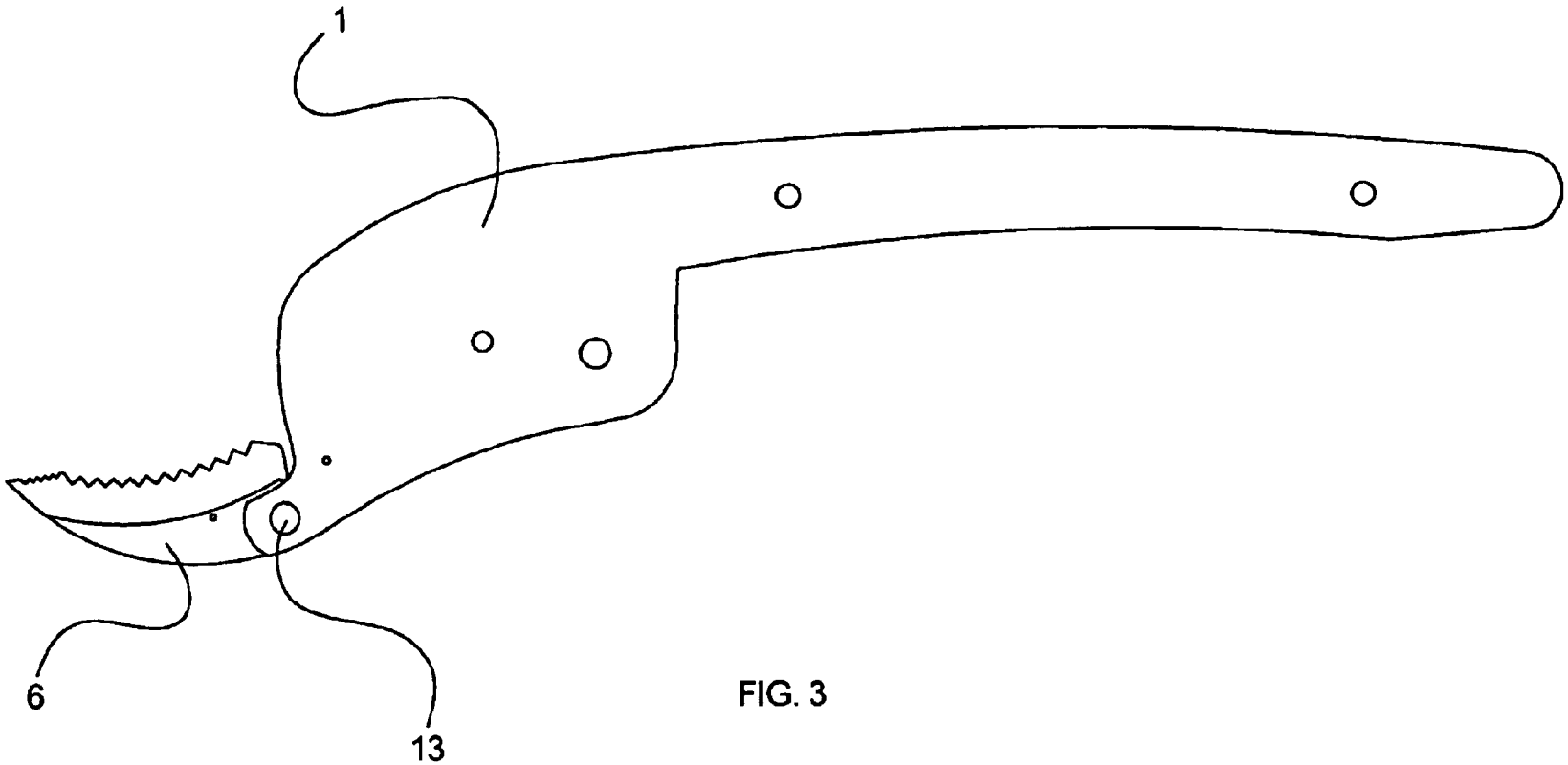
FIG. 3 shows the assembly of the braking jaw to the brake handle.

Shown in FIG. 3 is the attachment of the brake actuating jaw 6 to the brake handle 1. The brake actuating jaw, also called the braking jaw or brake jaw 6, attaches, or hingedly connects, to the brake handle via a brake actuating jaw pivot pin 13. This pin allows the braking jaw to rotate relative to the brake handle.

Figure 4:
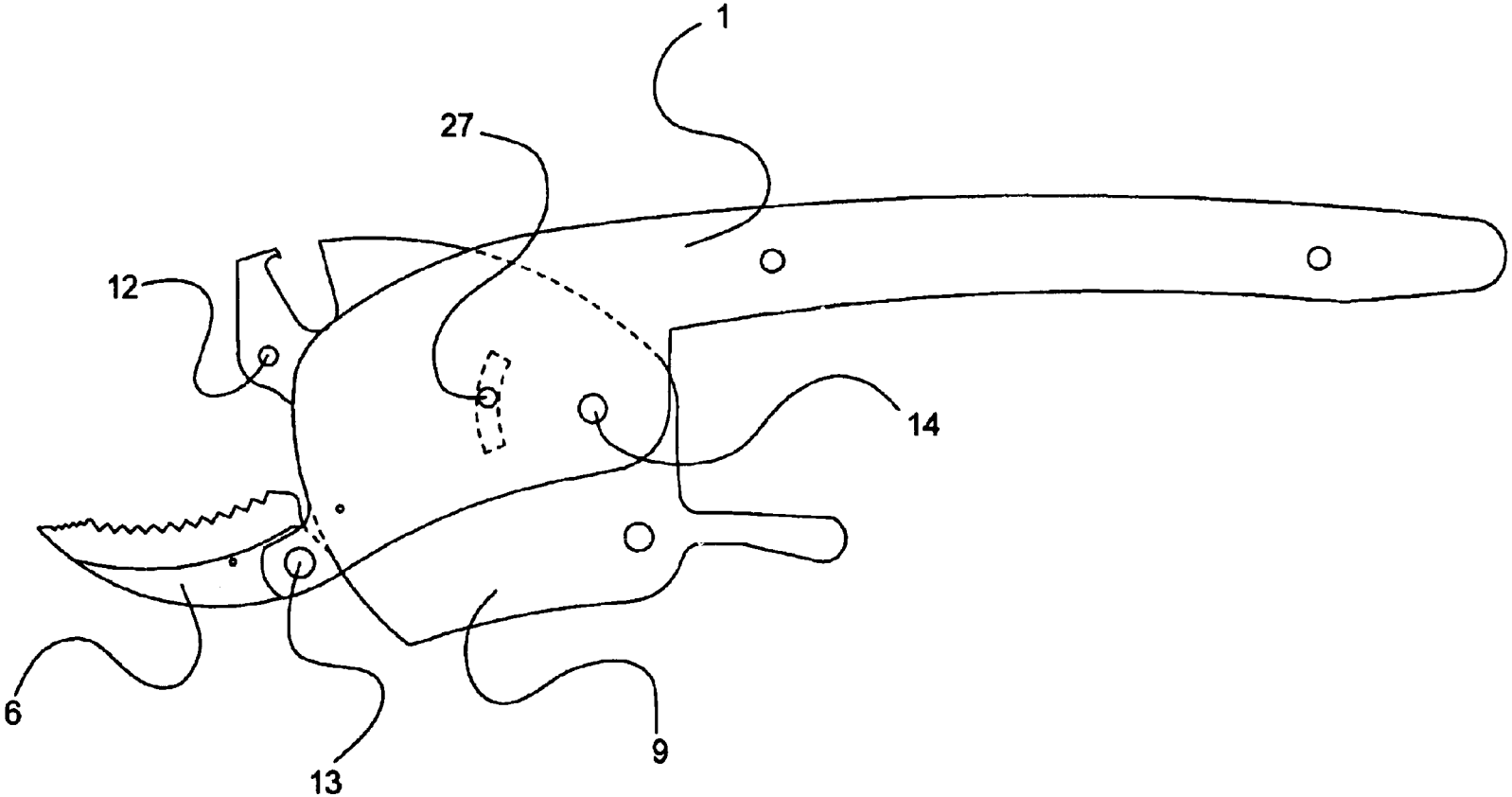
FIG. 4 shows the assembly of the brake handle and brake jaw to the main tool body.

FIG. 4 shows the brake handle pivot point 14 permitting rotation of the brake handle 1 relative to the main tool body 9. The brake handle and the main tool body are assembled to each other by this pin joint. A travel limiting pin-and-slot mechanism 27 controls the range of allowable rotation of the brake handle relative to the main tool body. In the preferred design, the pin of the mechanism passes through a hole in the brake handle and the slot of the mechanism is cut into the main tool body. The pin travels within the range of motion allowed by the slot as the brake handle rotates relative to the main tool body.

Figure 5:
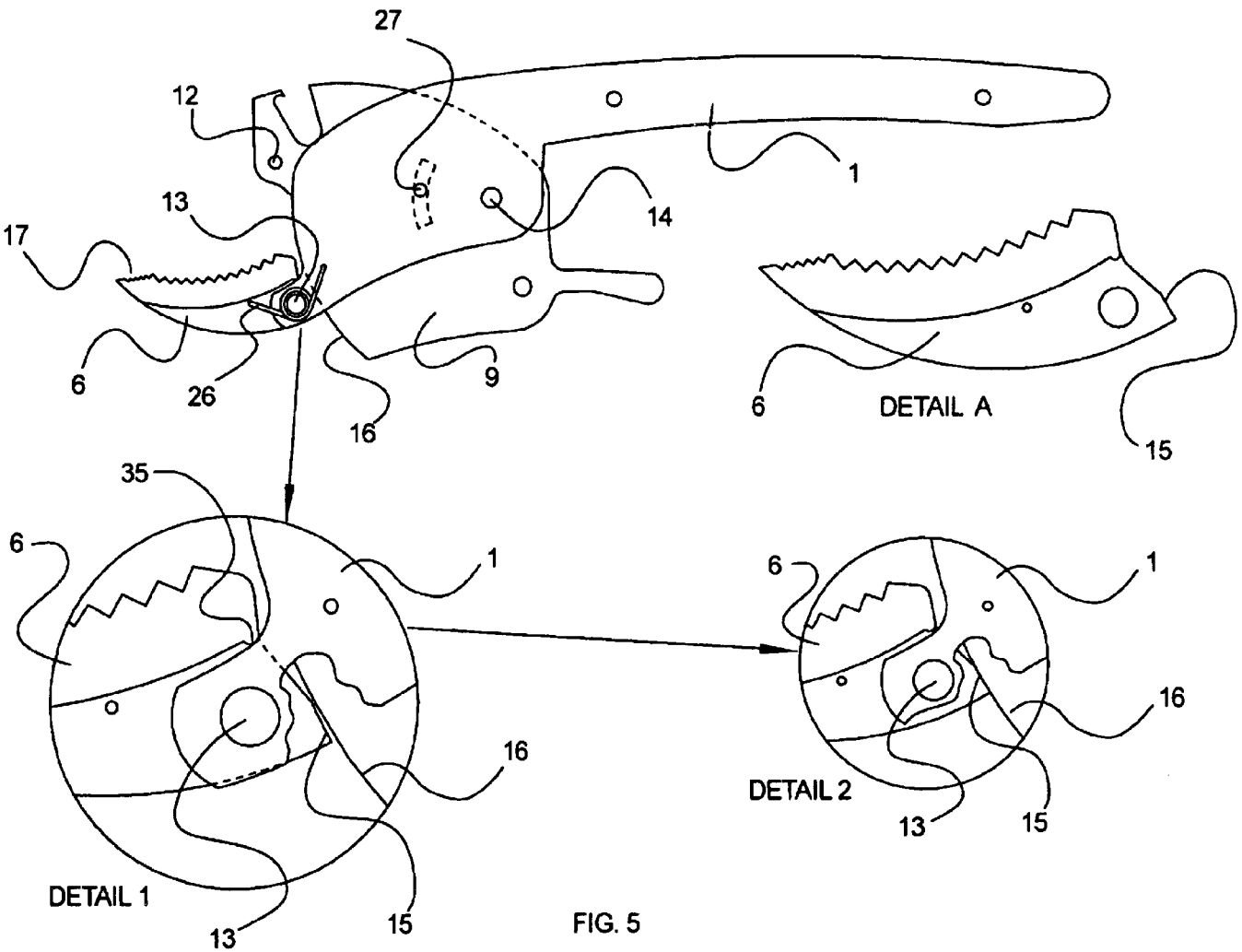
FIG. 5 emphasizes the interaction of the braking jaw with the main tool body.

FIG. 5 shows a view of the brake handle 1, the brake jaw 6 and a brake pad lifting spring, also described as a brake jaw spring 26, assembled to the main tool body 9. Detail A of FIG. 5 highlights a brake pad 15 that is a manufactured feature of the braking jaw 6. The brake pad is preferably not a flat surface but instead has a concave radiused face of engineered curvature. Shown in the assembly view of FIG. 5 is a convex brake surface 16 having the same engineered curvature as the brake pad surface and cut along the outline of the main tool body 9 and located such that the center of curvature of the brake surface 16 is coincident with the hole for the brake handle pivot 14 in the main tool body. In this manner, the brake surface 16 on the main tool body 9 and the brake pad 15 on the brake jaw 6 have curved, conforming geometry to maximize frictional contact area to effect a frictional engagement between the brake surface 16 and the brake pad 15 when the brake jaw 6 rotates about the brake actuating jaw pivot 13. Alternatively, the brake pad 15 could be manufactured as a flat surface or of geometry which does not conform well to the brake surface 16, but would still be functional as long as a mechanical engagement braking effect could be achieved by the brake pad 15 against the brake surface 16.

The unactuated position of the brake pad 15 is shown in Detail 1 of FIG. 5. The brake pad lifting spring of the assembly view has been omitted for illustration clarity. The brake pad lifting spring urges the brake pad 15 off of the brake surface 16 in the unactuated condition. The brake pad should be frictionally engaging the brake surface only when the brake jaw has come in to contact with a workpiece to be gripped. Coarse adjustment of the gap between the tool jaws occurs as the brake handle rotates relative to the main tool body. When the tool jaws are opening up to free a workpiece, or when the jaws are being coarsely adjusted to the proper gap size for the workpiece, it is necessary to urge the brake pad away from the brake surface so that brake handle rotation can take place. The brake pad lifting spring urges the brake pad 15 away from the brake surface 16 and rotates the brake jaw to a position where a braking jaw hardstop 35 rests against the brake handle contour. This ensures that the brake jaw orientation relative to the brake handle is constant in the unactuated position.

When a user closes the tool handles and begins to grip onto a workpiece, a force is applied normal to the workpiece face 17 of the braking jaw, shown in the assembly view of FIG. 5. The force normal to the face 17 causes the brake jaw to rotate relative to the brake handle 1 about the pivot pin 13. This rotation is opposed by the brake pad lifting spring 26 which is constantly trying to urge the brake pad off of the brake surface. Proper engineering of the brake-jaw spring will result in very little force at the workpiece face necessary to overcome the spring opposing force and the brake jaw will rotate about the pivot pin 13 due to the resulting moment induced by the force applied the workpiece face. As shown in the cutaway area of Detail 2 in FIG. 5, the braking jaw 6 rotates relative to the brake handle 1 until the brake pad 15 makes hard contact with the brake surface 16 of the main tool body. Hard contact of the concave brake pad 15 and the convex brake surface 16 results in a frictional engagement braking effect between the braking jaw and the main tool body 9. The frictional engagement braking force is proportional to the normal force acting on the workpiece face 17. The braking effect prevents the motion of the braking jaw relative to the main tool body, thereby temporarily setting the distance between the clamping jaw pivot pin 12 of the main tool body, and the braking jaw location. This frictional braking, induced by workpiece contact, automatically adjusts the gap between the tool jaws in order to properly accommodate the size of the workpiece being gripped and is thus an automatic jaw gap setting means. With this arrangement the user can easily adjust the tool to accommodate any sized workpiece which fits in between the jaw faces by simply squeezing the handles of the tool until the jaws make contact with the workpiece and the frictional brake actuates. When the workpiece is no longer exerting any force normal to the face 17 of the braking jaw, the brake pad lifting spring 26 disengages the frictional brake by rotating the brake jaw to lift the brake pad away from the brake surface and continues to rotate the jaw until the braking jaw hardstop 35 rests against the brake handle contour.

By careful selection of materials and production processes, a very high frictional coefficient can be engineered between the brake pad 15 and the brake surface 16. A lubricious environment variation of the locking pliers tool would have very small, matching tooth serrations cut into both the brake pad and the brake surface to provide positive, interfering mechanical engagement between the braking jaw and main tool body components. This variation could be used in a lubricious environment, such as an oily environment, where contaminants may affect the coefficient of friction between the brake pad and the brake surface.

Figure 6A:
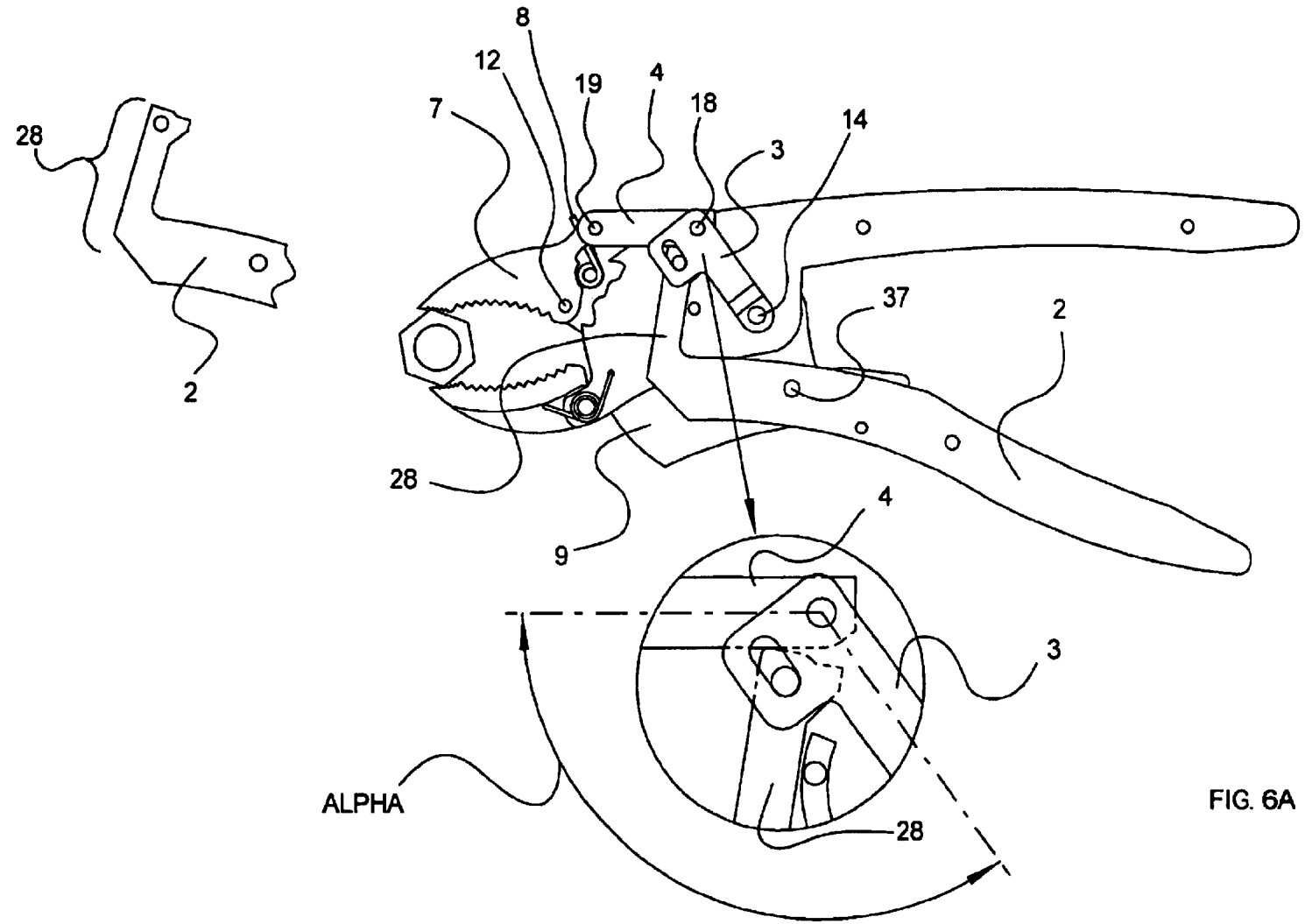
FIGS. 6*a* and 6*b* emphasize the relations of the link members which compose the over-center linkage of the tool.
Figure 6B:
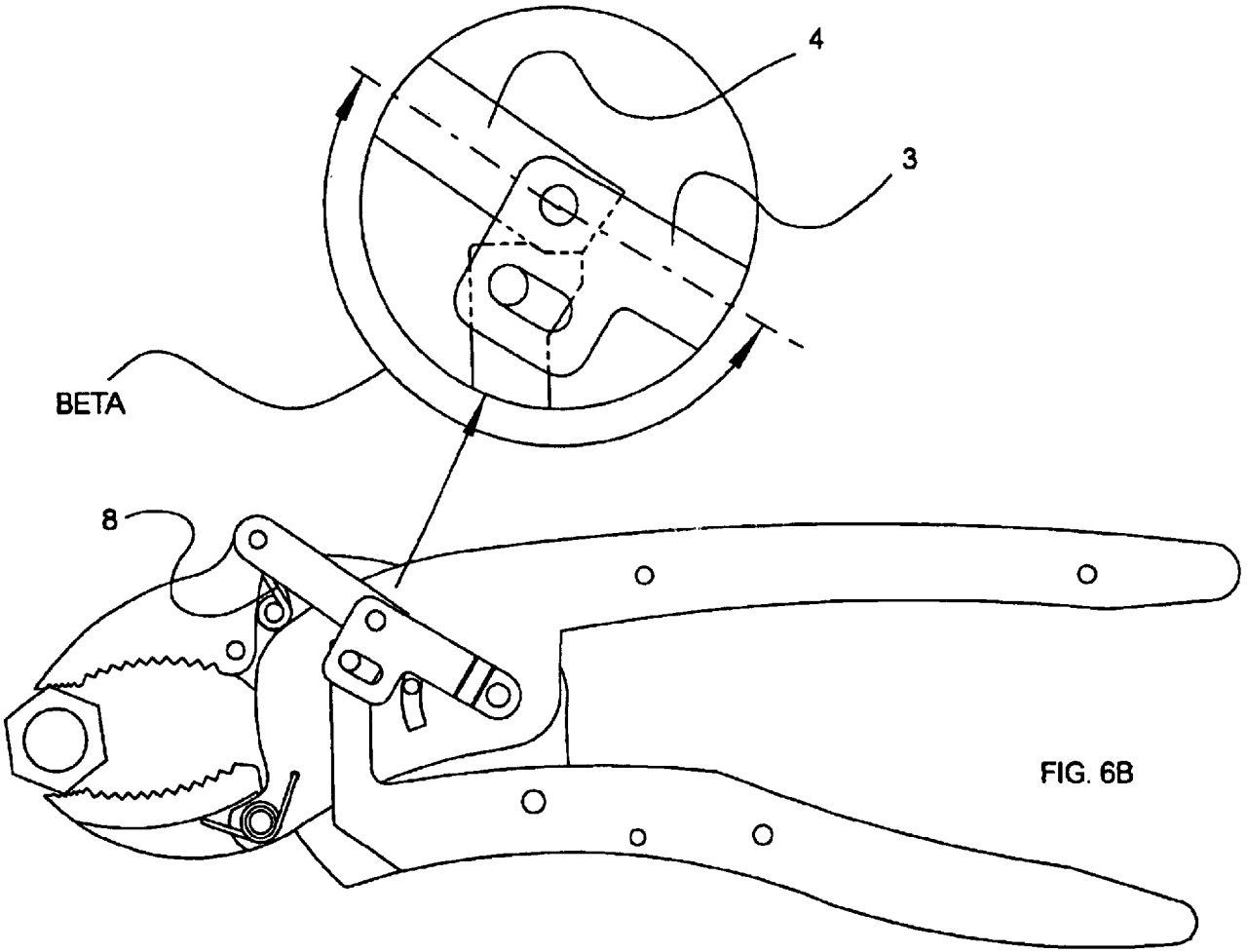

The over-center mechanism, highlighted in FIG. 6*a* and FIG. 6*b*, essentially consists of the slotted link 3, the clamp link 4, the clamping jaw 7 and the main tool body 9 in a four-bar linkage configuration. In the figures, some assembly components have been omitted for clarity. The over-center linkage members 3 and 4 are pinned to each other and to the other four-bar members at three pinning points. The slotted link 3 pins, or hingedly connects, to the main tool body 9 at the brake handle pivot 14. The slotted link and the clamp link 4 are pinned, or otherwise hingedly connected to each other at the over-center linkage pin joint 18. The clamp link is pinned, or otherwise hingedly connected to the clamping jaw 7 at the link-to-jaw pivot 19. The fourth link member, the clamping jaw 7, pins, or otherwise hingedly connects to the main tool body 9 at the clamping jaw pivot pin 12, as previously discussed. The clamp handle is pinned, or otherwise hingedly connected to the main tool body at the clamp handle pivot 37. Actuation of the over-center linkage mechanism is urged by the actuation arm 28 of the clamp handle 2. The actuating arm of the clamp handle is slidably coupled to a slot in the slotted link 3. In the preferred design the actuation arm 28 is integral to the clamp handle 2 but could be manufactured separately and affixed to the clamp handle through joining means known in the art such pinning, riveting or welding.

In FIG. 6*a*, a portion of the brake handle and clamping jaw have been cut away to more clearly illustrate the retracting spring 8. The retracting spring 8 is preferably located in a cutout of the main tool body and exerts a force against the pin at the link-to-jaw pivot 19 to keep the over-center linkage set at a user-defined initial included angle until the frictional engagement of the braking jaw has occurred. Actuation of the over-center linkage prior to frictional engagement of the braking jaw is undesirable. If the over-center linkage actuates before the jaw gap has been set by the frictional brake actuation, the clamping force desired by the user will not be attained. The retracting spring, having a lever arm length from the pivot pin 14 to its contact point at the pivot 19, should have an engineered spring constant large enough to produce a force which easily overcomes the force created by the brake pad lifting spring attempting to oppose rotation of the brake jaw. This ensures that as the workpiece exerts forces on the tool jaws it contacts, the braking jaw frictional brake actuates before the over-center linkage actuates. With the workpiece held between the jaws and the frictional brake actuated to set the gap of the tool jaws, continued gripping of the handle by the operator will begin to overcome the force of the opposing retracting spring 8 and the continued gripping action will consequently actuate the over-center linkage to aggressively clamp down onto the workpiece by initiating rotation of the clamping jaw face towards the brake jaw. FIG. 6*a* shows an enlarged detail view of the initial included angle Alpha between links 3 and 4. The initial angle Alpha is adjusted by the user and determines the amount of clamping force that will be exerted on the workpiece constrained within the tool jaws.

As the user continues to further close the handles after the brake jaw position has been fixed, the opposing force of the retracting spring 8 is overcome and the clamp handle 2 rotates about the clamp handle pivot 37 causing the actuation arm 28 to pull in a radial direction on the slotted link 3. The radial force exerted on the slotted link by the actuation arm urges the slotted link to rotate relative to the main tool body 9. Due to the four-bar linkage structure of the over-center linkage, rotation of the slotted link 3 increases the distance between the link to jaw pivot 19 and the brake handle pivot 14 as the three pins 14, 18 and 19 begin to co-align. The clamping jaw 7 is urged to rotate about the clamping jaw pivot pin 12 as the distance increases between the brake handle pivot 14 and the link-to-jaw pivot 19. Rotation of the clamping jaw closes the gap between the workpiece faces of the temporarily fixed brake jaw and the clamping jaw. The gap closure increases the clamping force that the jaws are exerting on the gripped workpiece. The clamping jaw is compressively loaded against the workpiece and the linkage members are in a compressive state between the two pivot locations 14 and 19. The user's gripping force, transferred through the clamp handle 2 and actuation arm 28, is highly magnified by the over-center linkage to create a compressive force acting on the workpiece at the clamping jaw workpiece face. The operator's gripping force is magnified at the clamping jaw workpiece face as determined by the mechanical advantage of the over-center linkage. The mechanical advantage is determined by the trigonometric relationship of the tensile force vector along the actuation arm 28 and the compressive forces acting along the linkage members 3 and 4, which an engineer experienced in the art could analyze with a force diagram.

FIG. 6*b* shows the relative orientation of the clamp link 4 and the slotted link 3 after the links have been rotated through co-alignment and have come to rest at the over-center position. It should be clarified that by "over-center" it is meant that the included angle between the link members 3 and 4 has changed from an initial angle Alpha which was less than 180 degrees, to a new included angle Beta which is more than 180 degrees. The instant where the link members are "centered" is when the two link members are rotated to an included angle of 180 degrees and hinge points 14, 18 and 19 are co-aligned or collinear. At the 180 degree position the link members are in a state of pure compression and the potential energy stored between the link members is maximized. To prevent the link members from undesirably reversing their rotation and completely relieving the clamp force on the workpiece, the linkage is rotated through the 180 degree angle to an over-center angle large enough to ensure that spontaneous link rotational reversal will not occur. Since the maximum compressive force in the links is achieved at the 180 degree included angle, it is desired to have the final included angle remain close to 180 degrees to transfer maximum compressive load to the workpiece. Prior art has taught that an included angle larger than about 183 degrees will be adequate to prevent unintended spontaneous linkage reversal. For the preferred design of the tool, the final included angle is about 185 degrees thus in the preferred design the "angle past center" is five degrees. A linkage hardstop feature engineered into the design prevents the linkage from exceeding about 185 degrees thereby maximizing clamping force without risking spontaneous link rotational reversal. At the final over-center angle the over-center linkage mechanism is forcing the clamp jaw to aggressively grip the workpiece without continued effort from the user and thus the tool is locked onto the workpiece until the user frees the workpiece. This position of the linkage when the final over-center angle has been achieved is also described as the clamp position of the over-center linkage. The final included angle between the links when in the clamp position is shown as angle Beta in FIG. 6*b*. The links will remain at the over-center position until the user opens the handles, which consequently returns the links to their initial included angle Alpha, shown in FIG. 6*a*. The user-defined initial angle Alpha, which the retracting spring 8 helps to urge, is also called the release position as this is the position that is urged when the tool handles are opened. By operating on the clamping jaw via the over-center linkage mechanism, the user can aggressively grip onto a workpiece of any size and geometry suitable to fit between the tool jaws. In the preferred design the user produces the release and clamp positions of the over-center linkage by actuating the linkage with the actuation arm 28, which is operably coupled to the linkage and is integrally manufactured into the clamp handle 2.

Figure 7A:
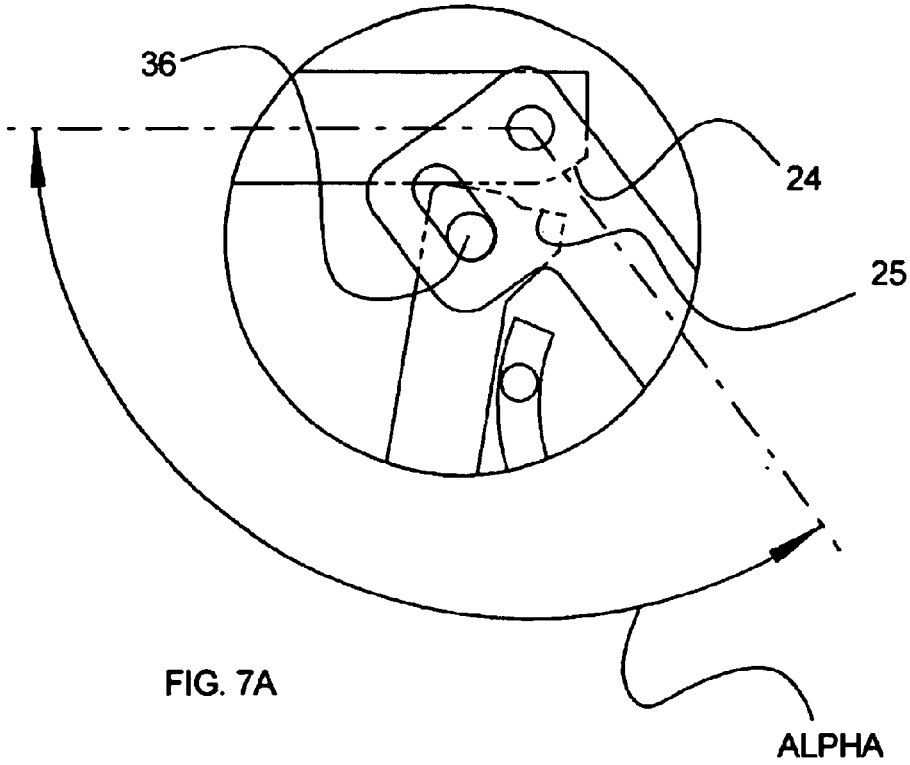
FIGS. 7*a* and 7*b* clarify the description of the included angle between the over-center linkage members.
Figure 7B:
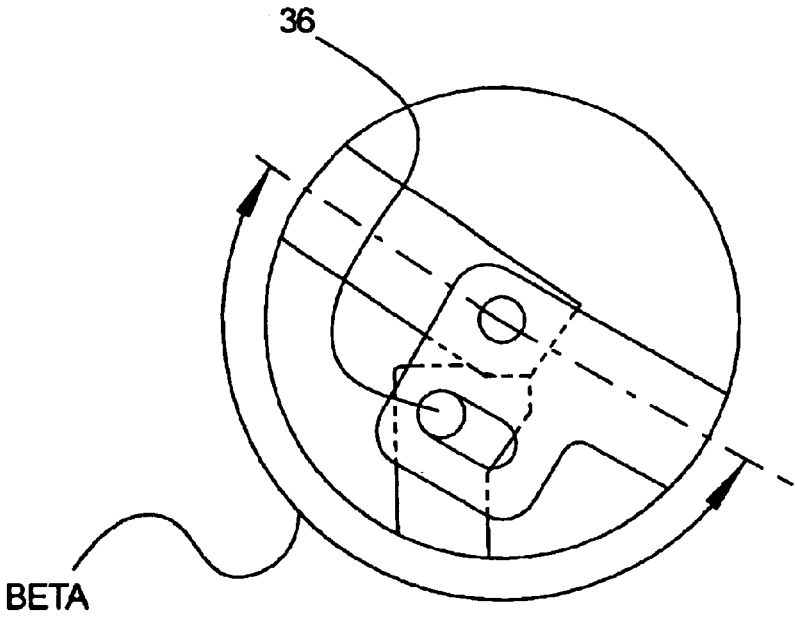

FIG. 7*a* shows the slotted link 3 and the clamp link 4 at the release position of angle Alpha before the actuation arm operates on them. The link hard stop surface 24 and the handle hard stop surface 25 are not in contact with each other. In FIG. 7*b* the slotted link 3 and the clamp link 4 are rotated to the clamp position where the included angle between the link members is Beta. FIG. 7*b* shows that the link hardstop surface 24 comes to rest against the handle hardstop surface 25 of the clamp handle when the links have achieved the final included angle Beta. Alternatively, the handle hardstop surface 25 could be eliminated and a second link hardstop surface could be manufactured into the slotted link and could interact with the first link hardstop surface 24 to control the final angle Beta of the link members.

Preferably the release position angle Alpha could be about 125 degrees and still have the retracting spring 8 remain in contact with the link-to-jaw pivot pin 19. The final angle Beta could be as large as 195 degrees but preferably is 185 degrees. The clamp position angle, Beta, can easily be engineered to be between 180 and 195 degrees by controlling the size of the slot cut into the slotted link 3 and engineering the dimensions of the link hardstop 24 and the handle hardstop 25. It is desirable to have the final linkage angle Beta be at least 183 degrees to prevent the slotted link from spontaneously reversing its rotation and releasing the clamp load on the workpiece while trying to achieve a clamp position. In the preferred design the final angle Beta is achieved as the slot pin 36 travels to the end of the slot in the slotted link and prevents further relative rotation between links 3 and 4.

When the tool aggressively clamps around a workpiece, the compressive forces in the link members store potential energy in the links. Because the link members 3 and 4 are attempting to achieve a lower state of stored potential energy in the clamp position, once they are past center the link members attempt to rotate as far a possible away from the maximum potential energy angle of 180 degrees and lower their stored potential energy. The tool will always achieve the same clamp position of the link members because the hardstop features engineered into the tool limit the linkage rotation to the angle Beta as the link members rotate over-center to lower their potential energy. The redundant hardstops 24 and 25 are designed to be load carrying surfaces when the links are at the clamp position angle Beta. The hardstops 24 and 25 are not necessary for the functional operation of the tool but are preferably included in the design to prolong the lifetime of the slot pin 36 and also prevent wear of the end of the slot.

Opening the handles returns the linkage members to the release position so that the workpiece can be freed from the jaws. The majority, but not all of the compressive load acting on the workpiece through the linkage members is relieved when the retracting spring urges the over-center linkage to the release position. The clamping force acting on the workpiece through the clamping jaw should be reduced to zero in order to easily remove the workpiece from the jaws and allow the brake pad lifting spring to reset the braking jaw back to the unactuated position As shown in FIG. 2, there is a small gap between the clamping jaw hardstop 34 and the surface of the main tool body which the hardstop would contact. When the user opens the tool handles and reverses the rotational direction of the slotted link, the retracting spring exerts a force against the link-to-jaw pivot pin 19 to urge the linkage members 3 and 4 to the initial angle Alpha. There is still a slight compressive force in the link members which causes a compressive force to remain at the clamping jaw workpiece face. This force is caused by the brake pad lifting spring still acting on the workpiece and being opposed by the clamping jaw. To relieve this remaining compressive force the user can exert a brief effort to open the handles of the tool such that the included angle between the link members is temporarily smaller than the initial included angle Alpha. The continued opening of the linkage to an angle smaller than Alpha causes the clamp jaw to rotate away from the brake jaw. At a release position of about 125 degrees the clamp jaw can still rotate away from the brake jaw until the hardstop 34 contacts the main tool body. A temporary over-rotation of the over-center linkage to an angle smaller than Alpha is sufficient to remove the residual compressive force caused by the clamping jaw opposing the brake pad lifting spring and consequently the workpiece can be freed from the tool jaws. With the workpiece removed and no appreciable force acting normal to the brake jaw workpiece face 17, the brake pad lifting spring resets the brake jaw to the unactuated position and the brake handle and brake jaw are free to rotate relative to the main tool body. With the brake jaw and brake handle free to move, the handle spring 10 opens the jaws to the largest gap that can be achieved so that another workpiece can be gripped.

Figure 8A:
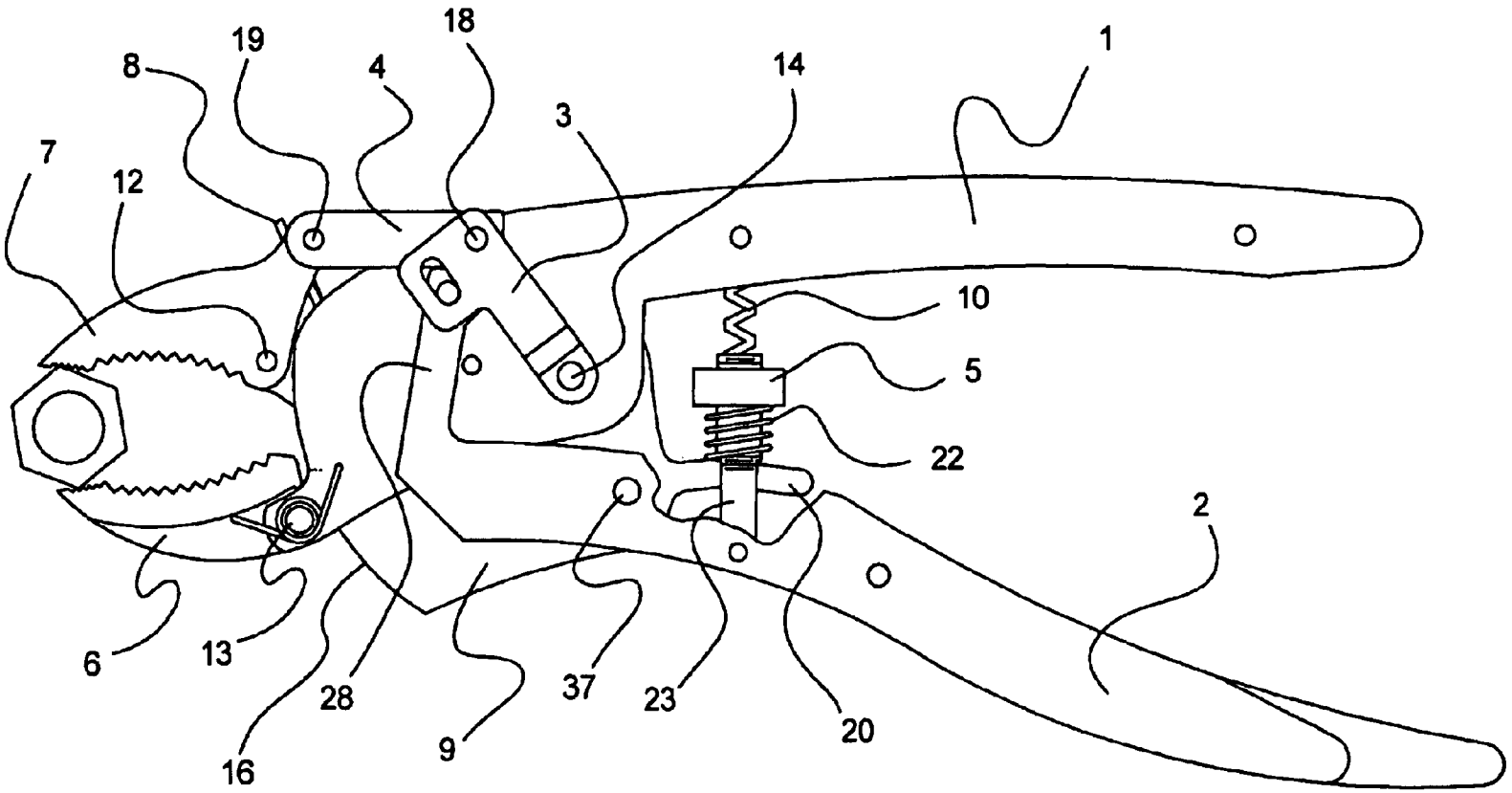
FIGS. 8*a* and 8*b* illustrate how the adjustment of the over-center linkage is performed.
Figure 8B:
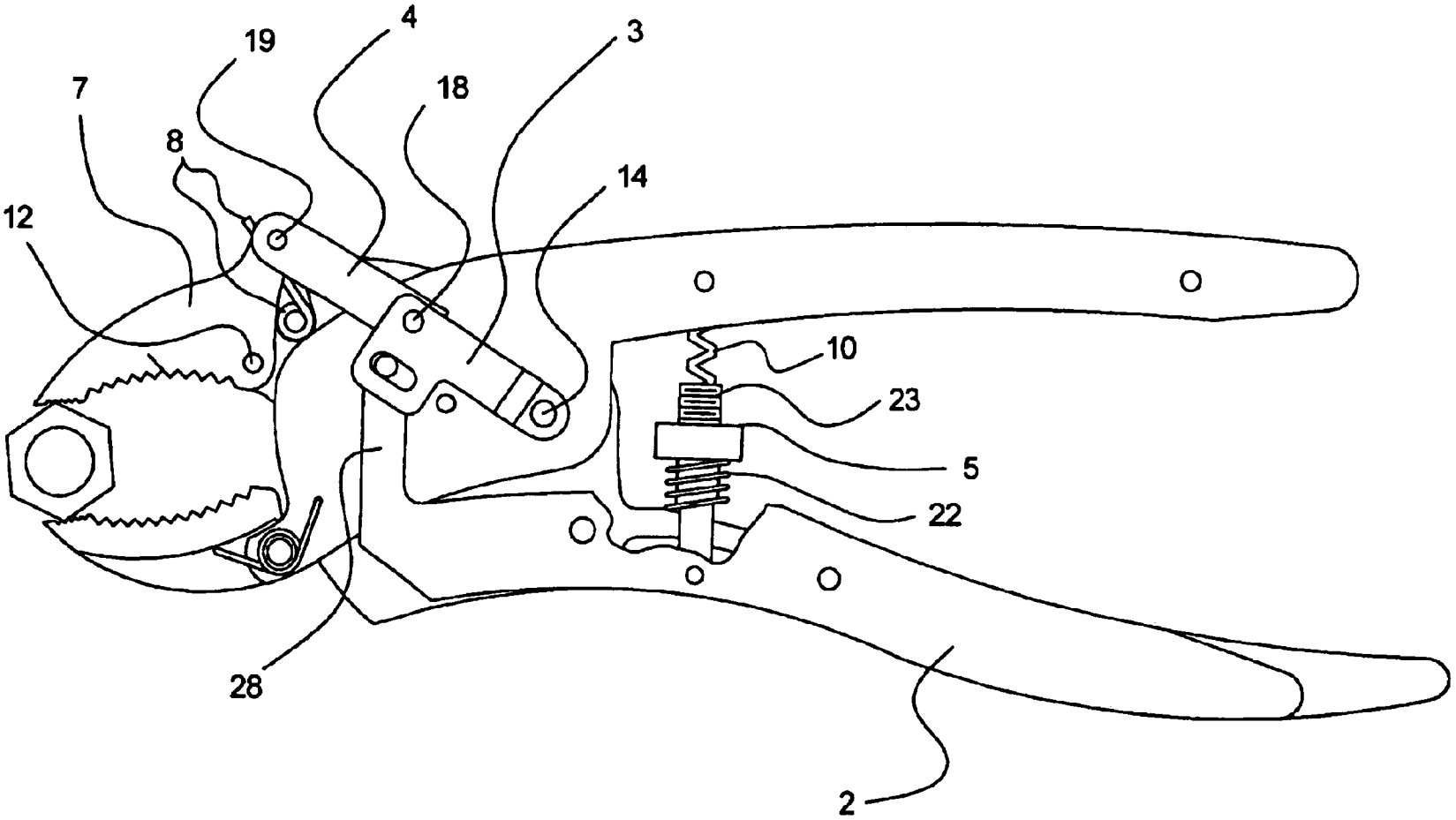

The maximum clamping force that will be acting on the workpiece through the link members is dependent upon the initial included angle between the clamp link 4 and the slotted link 3. FIGS. 8*a* and 8*b* show the setting of the initial included angle Alpha by usage of a linkage angle setting means which, in the present design, is an adjustment thumbwheel 5. In the figures, a portion of the clamp handle has been cut away for illustration clarity. An adjustment screw 23 is attached to the clamp handle 2 to adjust the travel of the clamp handle relative to a shelf 20 extending from and integral to the main tool body 9. A spacing means 22, shown as a semi-rigid spring, but which alternatively could be a tube section or shim or other suitable material known in the art, opposes rotary motion of the clamp handle once the spring 22 comes to rest on the shelf 20. The adjustment thumbwheel 5 controls the maximum angle that the clamp handle 2 can rotate relative to the shelf 20 before the spacing means 22 opposes the angular movement. To develop the largest clamping force with the over-center linkage, the initial included angle Alpha, also described as the release position, should be set at the smallest included angle possible. As mentioned previously the angle of linkage pivot co-alignment or centering is 180 degrees. In the present design the smallest included angle which can be achieved is about 125 degrees which achieves an "angle before center" of about 55 degrees. By controlling the distance between the thumbwheel 5 and the shelf 20, the user controls the rotation of the clamp handle 2 relative to the main tool body 9 as the handles are opened, and consequently controls the initial included angle Alpha of the link members 3 and 4. In the preferred design the user can vary the angle Alpha from about 125 degrees to about 175 degrees to achieve a high or a low clamping force on the workpiece, respectively.

As shown in FIG. 8*a*, with the adjustment thumbwheel 5 set near the top of the adjustment screw 23, the clamp handle achieves the largest rotation relative to the main pliers body before the spacing means opposes the clamp handle rotation. With this large angular rotation of the clamp handle, the actuation arm 28 drives the link members to a release position of approximately 125 degrees. When the user grips the tool handles together to aggressively clamp onto a workpiece contacted by both jaws of the tool, the actuation arm 28 pulls the pins 14, 18 and 19 into co-alignment starting from the release position. At this particular adjustment setting the distance between pivots 14 and 19 increases significantly while the link members are traveling from the release position of about 125 degrees to the clamp position of about 185 degrees. The clamping jaw 7 rotates about the clamping jaw pivot pin 12 as the link-to-jaw pivot 19 drives the jaw rotationally toward the brake jaw. The compressive force in the link members increases significantly as the workpiece held by the jaws opposes the large clamping jaw rotation and a high compressive force results at the clamping jaw workpiece face. For descriptive purposes, the thumbwheel adjustment wherein the release position initial angle Alpha of the linkage members is approximately 125 degrees is referred to as a hard clamp adjustment, with a progressively larger initial angle Alpha resulting in a progressively lighter final clamping force.

As shown in FIG. 8*b*, with the adjustment thumbwheel 5 of the preferred design advanced many threads onto the adjustment screw 23 the initial linkage angle Alpha is about 175 degrees. At this setting the angle before center is about equal to the angle past center and so the final clamping force will be very low at the clamp position because the link-to-jaw pivot 19 does not travel a significant relative distance as the link members 3 and 4 are rotated from the release position to the clamp position. For descriptive purposes, the thumbwheel setting wherein the absolute value of the angle before center is only slightly greater than the absolute value of the angle past center is referred to as a soft clamp adjustment. The absolute value of the angle before center must always be greater than the absolute value of the angle past center if the over-center linkage is to develop any clamping force on the workpiece at the clamp position due to over-center linkage actuation.

It is preferable to have the spacing means 22 engineered as a semi-rigid component in order to allow the clamp handle 2 to be briefly rotated further than the position controlled by contact of the spring 22 and the shelf 20 when opening the handles. This excess travel allows the operator, through the handle and link member relations to temporarily over-rotate the clamp jaw 7 away from the braking jaw. This temporary over-rotation of the clamping jaw helps to free a workpiece constrained within the jaws. Without the capability for temporary over-rotation, freeing the workpiece would require the user to carefully wrestle the handles apart or to wrestle the workpiece from the jaws because forces still remain due to the brake pad lifting spring still compressing the workpiece. Either method invites opportunity for undesired consequences such as marring the workpiece or dropping the workpiece. As discussed previously, temporary over-rotation capability is the reason for the slight gap between the clamping jaw hardstop surface 34 and the contacting surface of the main tool body. If the user has adjusted the thumbwheel 5 to the hard clamp adjustment setting, the retracting spring 8 may lose contact with the link-to-jaw pivot pin 19 during the temporary over-rotation used to free the workpiece from the jaws. When the user wishes to clamp onto another workpiece, squeezing the handles will cause the pin 19 to reestablish contact with the retracting spring 8 to reset the over-center linkage back to the initial angle Alpha if opening the handles has caused contact to be broken between the pin 19 and spring 8.

The retracting spring 8 urges the clamping jaw 7 and over-center linkage members 3 and 4 to always return to the same release position as determined by the adjustment thumbwheel 5 location on the adjustment screw 23. The spring 8 pushes against the pin at the link-to-jaw pivot 19 to always urge the distance between pins 19 and 14 to be the minimum distance possible. As designed, the retracting spring 8, in performing the pin distance minimizing function, also drives the clamp handle 2 to rotate as much as possible relative to the main pliers body due to the coupling of the clamp handle 2 to the slotted link 3. The clamp handle rotates as far as possible until the spacing means 22 contacts the shelf 20 as determined by the adjustment thumbwheel setting. With the spring 8 urging the linkage members to return to the same release position angle as set by the user, the user applies nearly the same clamping force, with minimal force variation, to each clamped workpiece until a new release position setting is selected via the thumbwheel.

Figure 9:
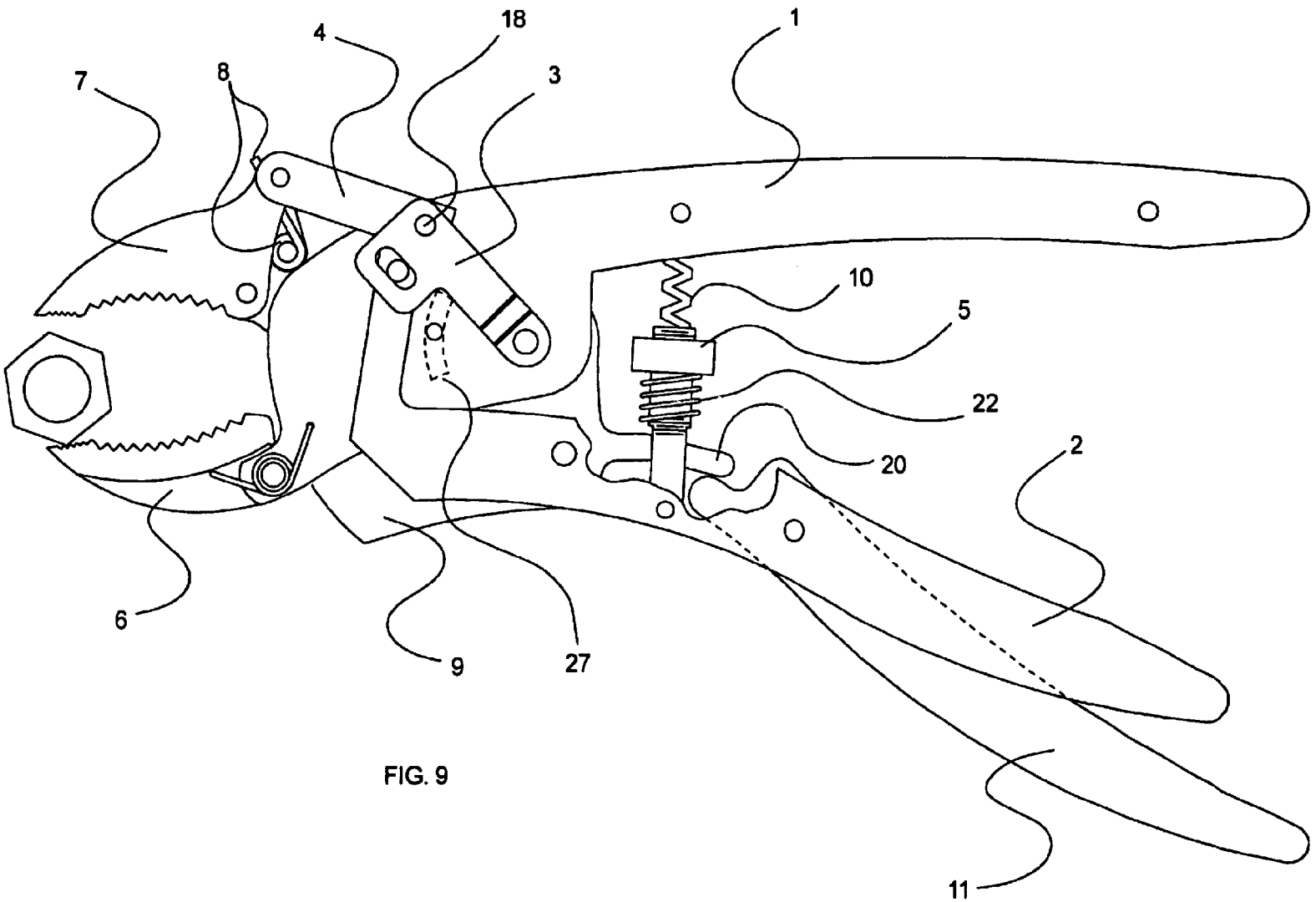
FIG. 9 illustrates the use of a release lever to open the handles of the tool in order to free the workpiece from the tool jaws.

Whether the operator desires to use a hard clamp adjustment setting, a soft clamp adjustment setting, or any setting in between these two extremes, the user simply removes the clamping force on the workpiece by opening up the handles of the tool. A release lever 11, shown in FIG. 9, is adapted to the tool and is used to help urge the over-center linkage away from the clamp position and toward the linkage release position. In the figure a portion of the clamp handle 2 has been cut away for illustration clarity. The release lever gives the operator increased mechanical advantage against the clamp handle and actuation arm when it is desired to reverse the rotation of the link members 3 and 4 away from the clamp position and back towards the release position. When the included angle between the links changes to less than 180 degrees the retracting spring 8 assists to urge the linkage members to return to the user-adjusted release position.

In the preferred design the handle spring member 10 urges the brake handle 1 to rotate relative to the main tool body 9 to return the brake jaw 6 to the largest opening between the opposable jaws. The travel limiting pin and slot 27 mechanism prevents over-travel of the brake handle as the brake handle is being urged to the fully opened position by the brake handle spring 10. The handle spring also ensures that the tool handles are always lightly opposing the operator's grip which keeps the handles in contact with the operator's fingers and palm to allow the operator more control of the locking pliers tool during pre-clamping manipulation.

Figure 10A:
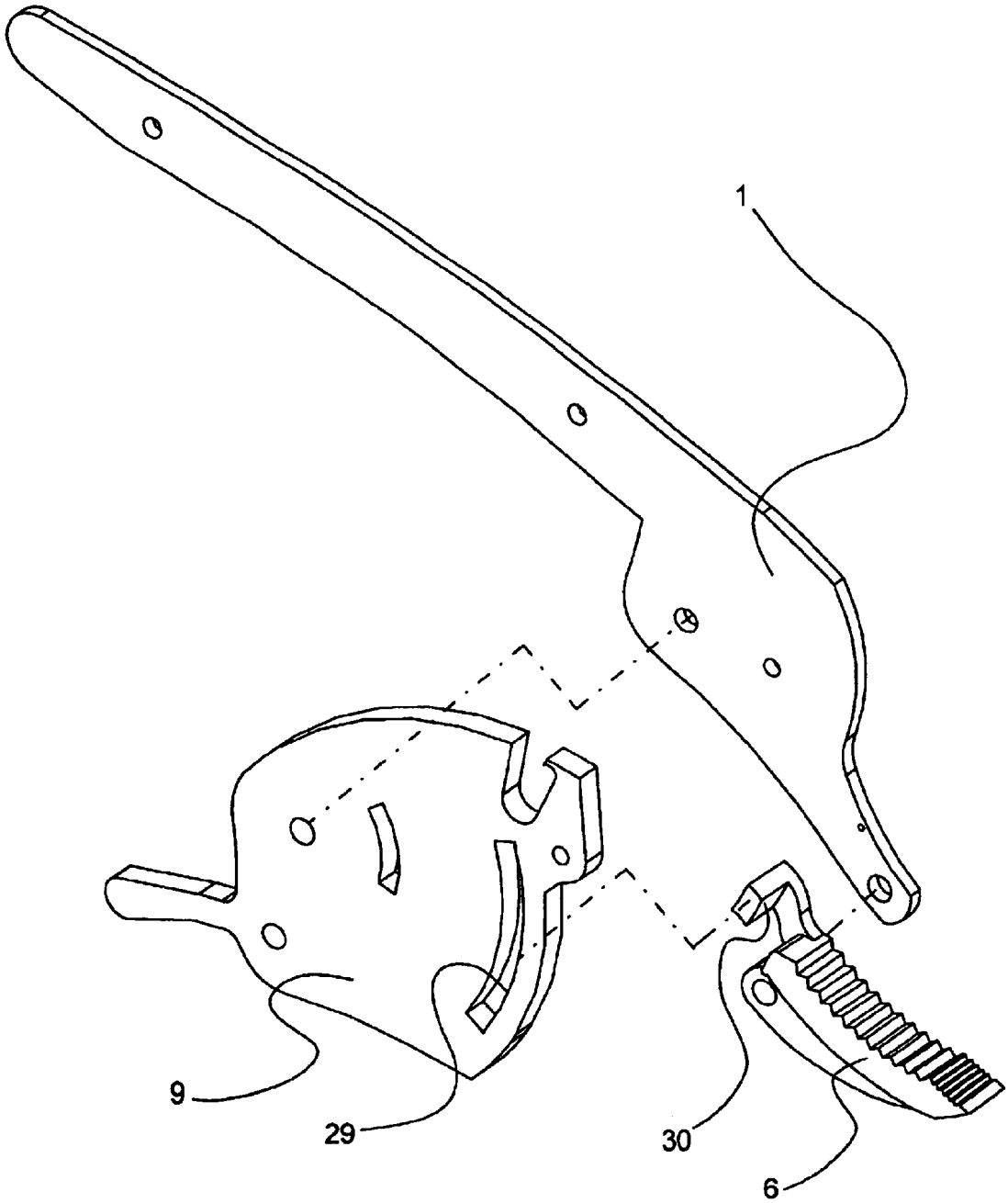
FIGS. 10*a*, 10*b* and 10*c* show an alternative brake mechanism for the invention.
Figure 10B:
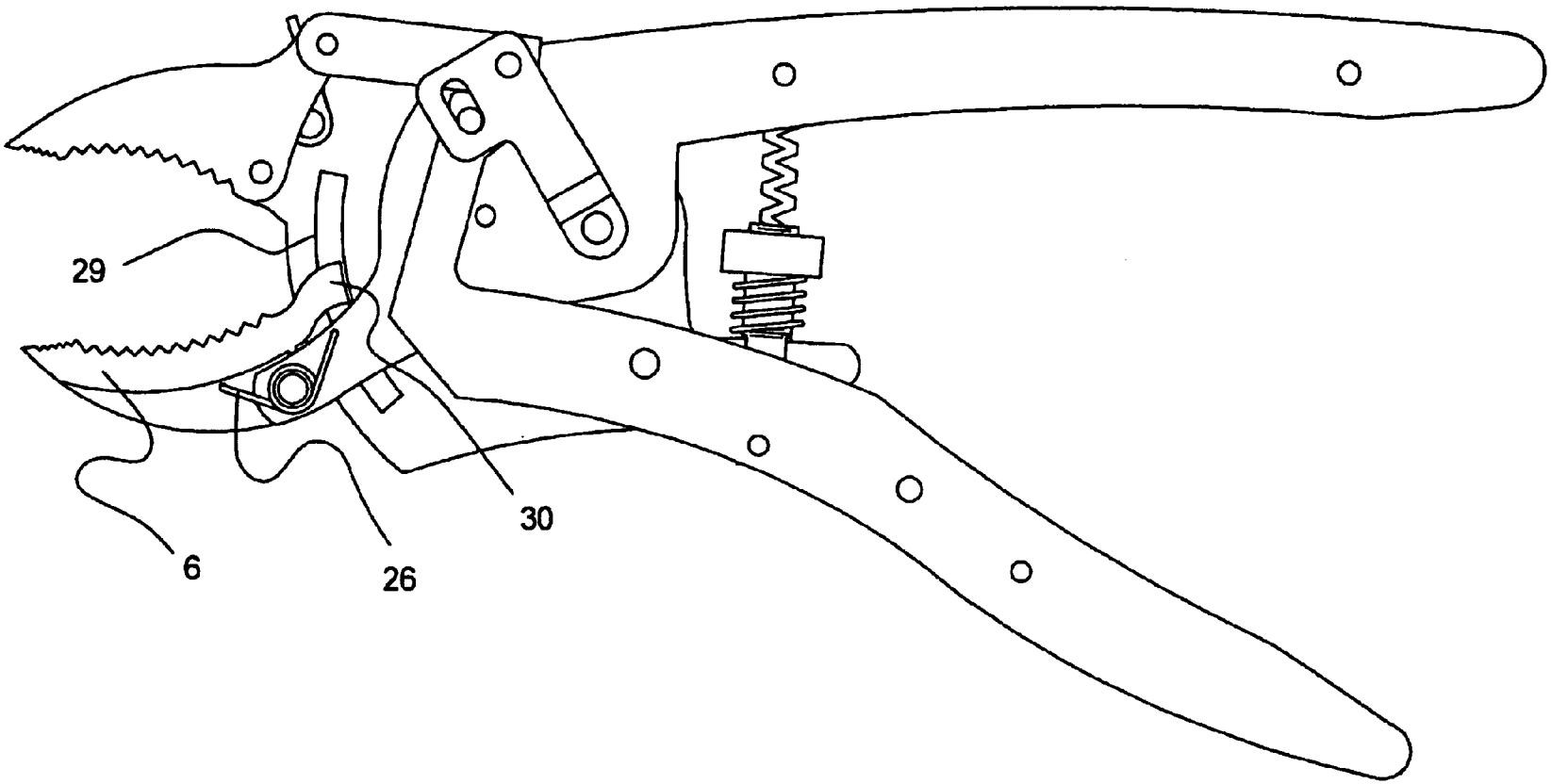
Figure 10C:
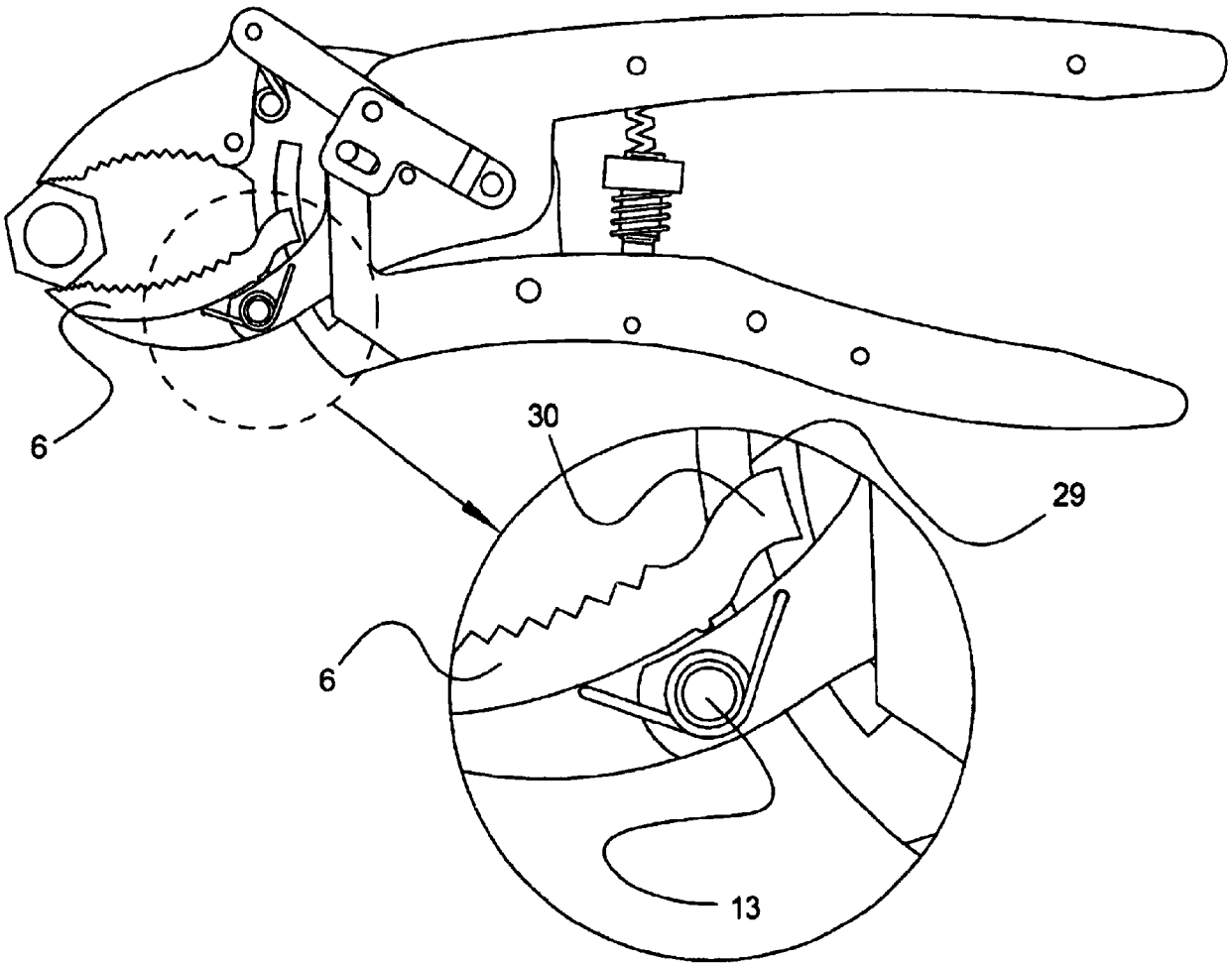

FIGS. 10*a* through 10*c* show a variation of the braking mechanism wherein the brake pad has a convex curvature and the brake surface has a concave curvature. As shown in FIG. 10*a* the braking jaw 6 still rotatably attaches to the brake handle 1 and the brake handle rotatably attaches to the main tool body 9. With this variation the convex brake pad 30 travels in a concave brake surface slot 29 cut into the main tool body. As shown in FIG. 10*b* the brake pad lifting spring provides a means to urge the convex brake pad 30 to the open position where it is lifted off of the concave brake surface 29. As in the preferred design, using the brake pad lifting spring to urge the pad from contacting the brake surface permits the brake handle to rotate unimpeded relative to the main tool body for sizing the jaw gap to the workpiece and for opening the jaws. FIG. 10*c* illustrates that the frictional brake of this alternative design actuates when the brake jaw 6 contacts a workpiece. As in the preferred design, the event of the workpiece contacting the brake jaw will cause the jaw to rotate about the brake actuating jaw pivot 13 which allows the convex brake pad 30 to contact the concave brake surface 29 and cause frictional engagement of the brake. The frictional engagement temporarily locks the position of the brake jaw relative to the main tool body. This design is less desirable due to higher frictional coefficients required between the frictional brake surfaces in order to ensure that the brake pad 30 will not slip on the brake surface 29 once the brake has been actuated. Alternatively, instead of frictional engagement only, it is possible to incorporate small serrations on the convex brake pad and the concave brake surface to permit interfering mechanical engagement of the pad 30 and brake surface 29 to enhance the reliability of the brake in this design. The over-center linkage and clamping jaw of this design could have the same included angle adjustment means and same linkage actuation mechanism as the preferred design.

As can be seen in FIG. 8*a*, the preferred design of the locking pliers tool is an adjustable tool built of a main tool body 9 which has a brake surface 16. A brake handle 1 is hingedly connected to the main body at a first hinge point 14 and a clamp handle 2 is hingedly connected to the main tool body at a second hinge point 37, and a clamping jaw 7 is hingedly connected to the main tool body at a third hinge point 12. A brake jaw 6 is hingedly connected to the brake handle 1 at a fourth hinge point 13 such that the brake jaw can rotate to effect a frictional engagement between the brake surface 16 of the main tool body and a brake pad manufactured as part of the brake jaw. An over-center linkage mechanism, consisting of a clamp link 4 and a slotted link 3, is hingedly connected to the clamp jaw 7 at the end of a first link and hingedly connected to the main tool body at the end of a second link, and operates to achieve a release position and a clamp position. An actuating arm 28 is operably coupled to the over-center linkage to produce the release and clamp positions of the over-center linkage. A clamp-jaw spring 8 urges the over-center linkage toward the release position.

Figure 11A:
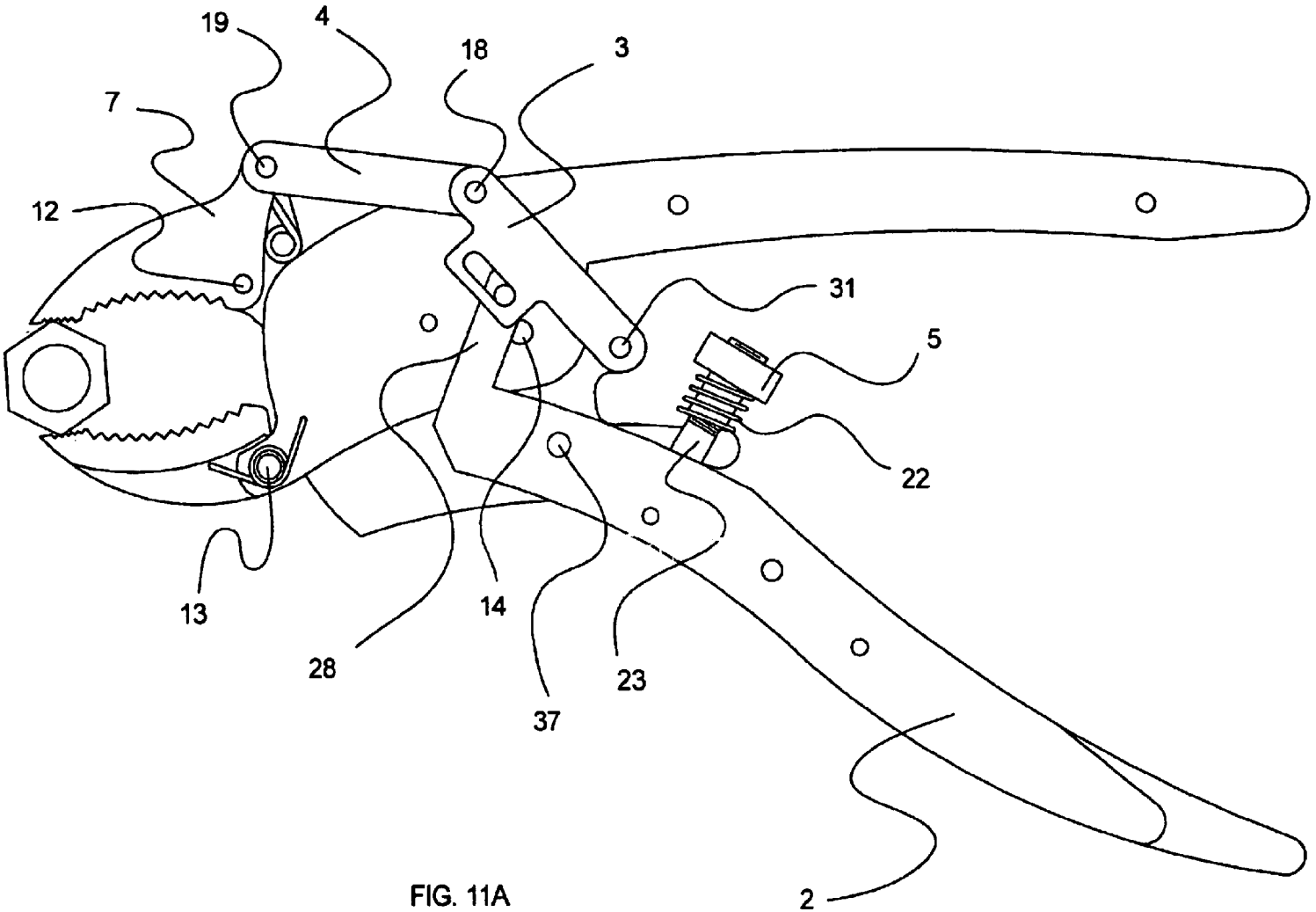
FIGS. 11*a* and 11*b* show an alternative linkage assembly scheme for the over-center linkage of the tool.
Figure 11B:
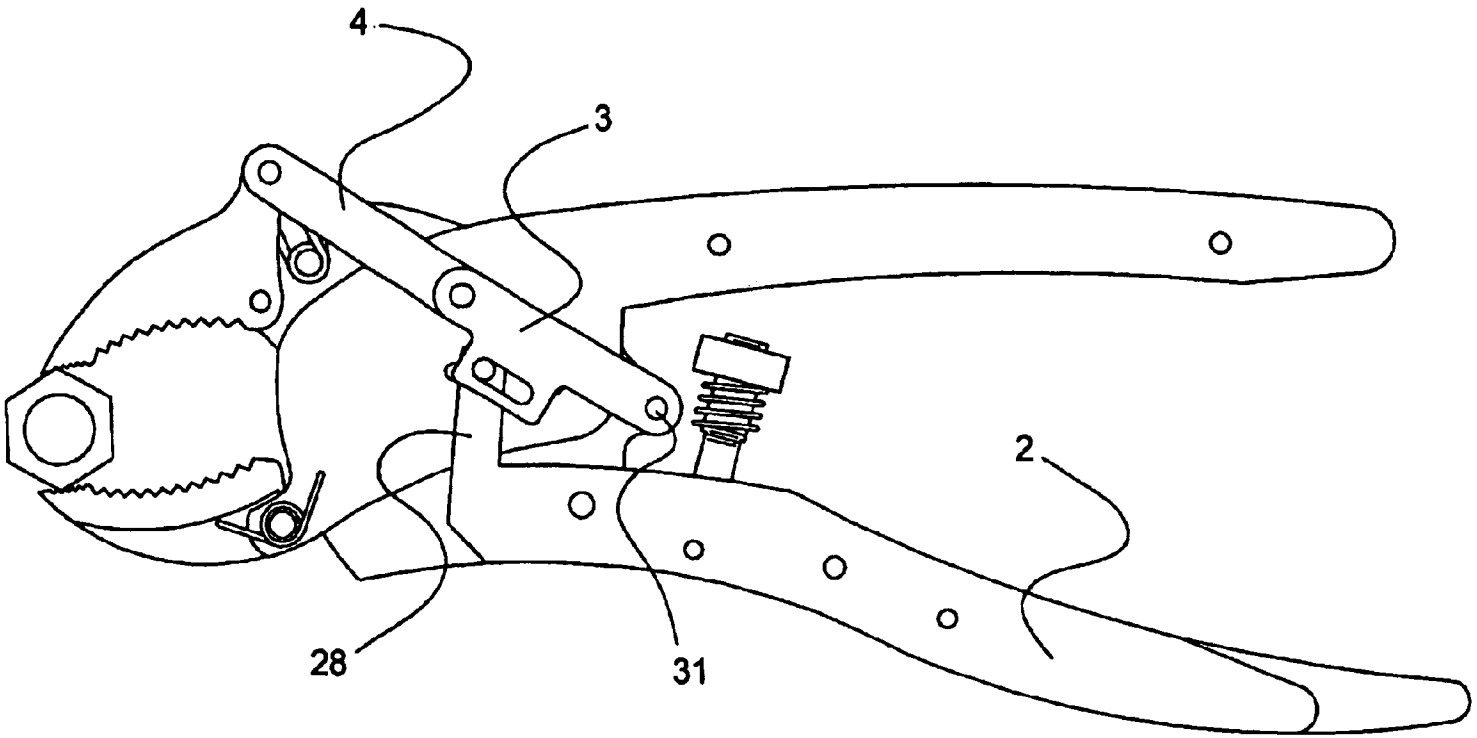

Alternatively, a variation of the over-center linkage such as the design shown in FIGS. 11*a* and 11*b* could be used to actuate the clamping jaw mechanism of the tool regardless of the design of the brake engagement mechanism. This variation of the over-center linkage includes a clamp link 4 and a slotted link 3 wherein the clamp link is hingedly connected to the slotted link and is also hingedly connected to the clamp jaw 7. The other end of the slotted link is hingedly connected to the main tool body at a fifth hinge point 31, which is a slotted link fixed pivot point on the main tool body. This differs from the preferred design in that the preferred design has the first hinge, the brake handle pivot 14, and the fifth hinge, the slotted link fixed pivot 31, as coincident points located at the brake handle pivot whereas this alternative design separates the two hinge points. The actuating arm 28 is still slidably coupled to a slot in the slotted link in this alternative design. The release position of the over-center linkage is still adjustable by the user through the use of a variable position mechanism such as an adjustment thumbwheel 5 and spacing means 22 The clamp position of the over-center linkage is still able to be engineered by the dimensions of the slot in the slotted link. As can be seen in FIG. 11*b*, this variation has all of the capability of the preferred design to automatically adjust for the size of the workpiece and achieve a clamp position to aggressively grip the workpiece, but has the slight disadvantage of requiring additional features in the main tool body. The advantage that this design offers is that the lengths of links 3 and 4 could be longer than the links 3 and 4 in the preferred design of FIG. 8*a* to provide additional mechanical advantage to the user when clamping onto a workpiece.

Figure 12A:
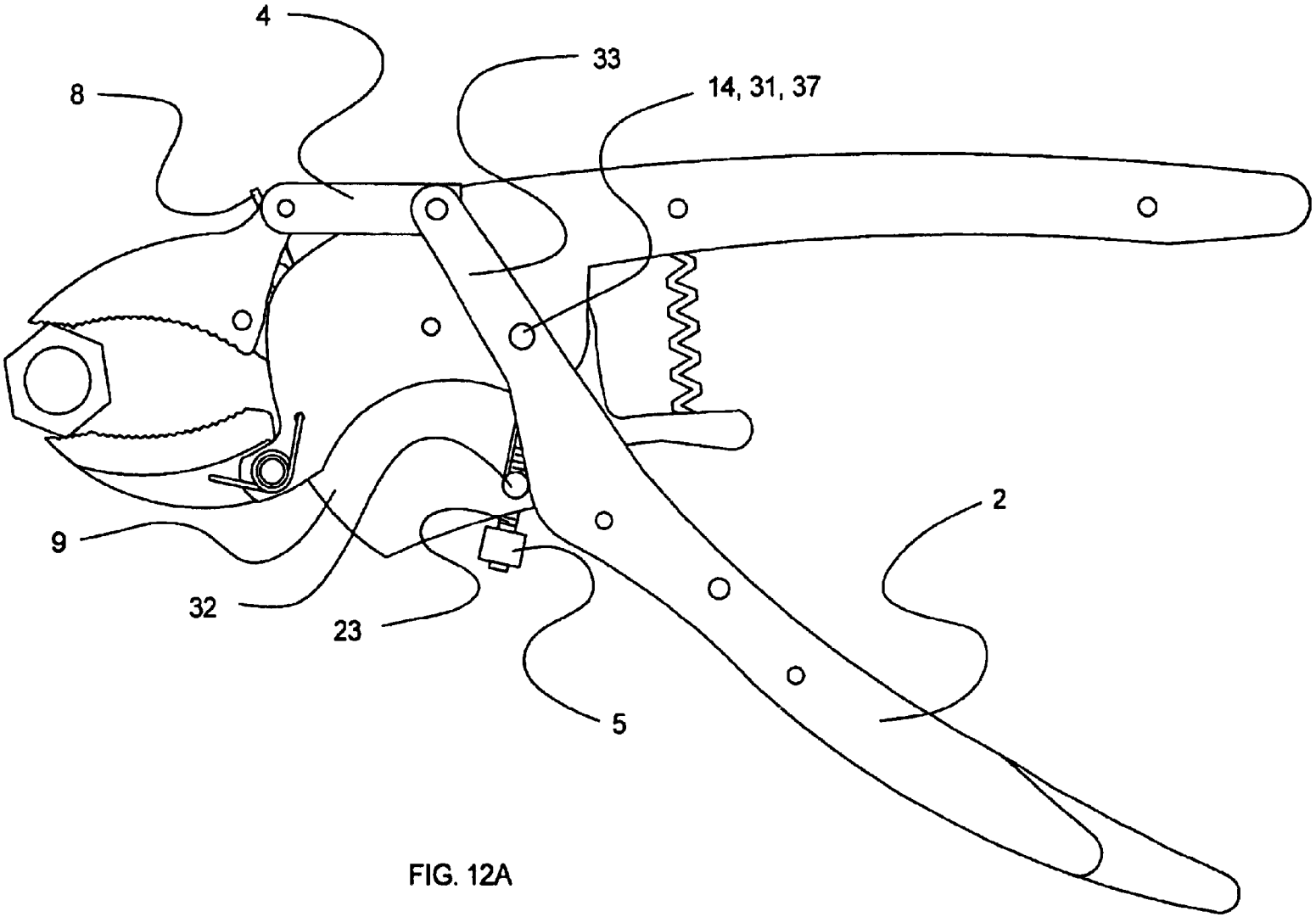
FIGS. 12*a* and 12*b* show an alternative clamp handle design for the tool.
Figure 12B:
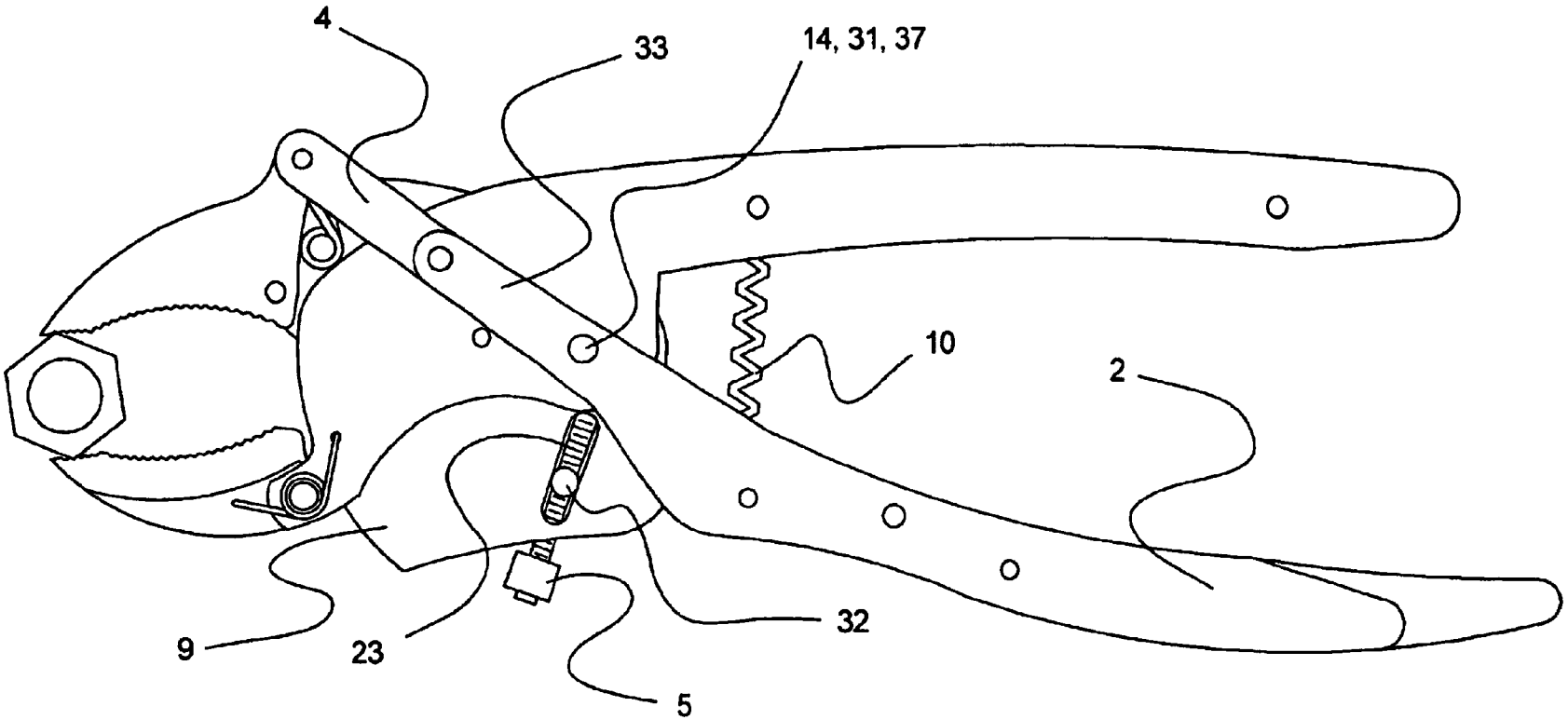

FIGS. 12*a* and 12*b* show another variation of the design wherein the actuating arm is still integral with the clamp handle 2 but is also forming a link in the over-center linkage. The combined slotted link and actuation arm form the actuating link portion 33 of a clamp handle. In this variation of the design the hinge point for the brake handle, the clamp handle and the slotted link have all been made coincident, shown in figures as the coincidence of points 14, 31 and 37. To be more specific, the first hinge point, the second hinge point and the fifth hinge point have all been made coincident. Referring briefly to FIGS. 11*a* and 11*b*, it is also possible to build this variation of the design with the second hinge point for the clamp handle 37 and the fifth hinge point for the slotted link fixed pivot 31 to be coincident to each other without having the first hinge brake handle pivot 14 coincident to the second and fifth hinges. The disadvantage to combining the actuation arm and the slotted link together as the actuating link portion 33 of the clamp handle is that the rotation of the clamp handle increases significantly as the handles open, which makes it difficult for a user with smaller hands to operate the tool single-handedly. The release position of the over-center linkage, now consisting of links 4 and 33, is still controlled by an adjustment thumbwheel 5, an adjustment screw 23 and a movable clamp handle hardstop 32. The adjustment screw 23 rotates but does not translate relative to the main tool body. Turning the thumbwheel 5 translates the movable hardstop 32 along the adjustment screw 23 to control the maximum rotation of the clamp handle 2 relative to the main tool body 9 when the handles open. Control of the maximum relative rotation consequently controls the release position for the over-center linkage. The movable hardstop would preferably be manufactured as a semi-rigid, compliant member in order to allow temporary over-rotation of the clamp handle as the tool jaws are being opened. As discussed in relation to hardstop feature 34 of the preferred design and the compliance of the spacing means 22 of the preferred design, if the hardstop 32 is rigid, the user may have to gently wrestle the jaws apart or wrestle the workpiece from the jaws to free it due to the brake pad lifting spring still compressing the workpiece even though the handles have been opened. The hardstop 32 could be manufactured as a semi-rigid component by making it as a roll pin or a sort of spring member through means known in the art. As discussed in the preferred design, the alternative design shown in FIGS. 12*a* and 12*b* has a retracting spring 8 which urges the over-center linkage toward the release position.

The advantages of the invention are a brake mechanism, an over-center linkage mechanism and a linkage angle setting means combined into one locking pliers tool. The novel integration of a brake mechanism integrated into the first opposable jaw permits automatic jaw gap adjustment for workpieces of varying size. The over-center linkage mechanism integrated into the second opposable jaw enables the operator to apply a repetitive jaw clamping force regardless of the workpiece size. The linkage angle setting means controls the included angle between the over-center linkage members to allow the user to adjust the magnitude of the clamping force that will be applied to the workpiece.

While the embodiments described herein are at present considered to be preferred, it is understood that various modifications and improvements may be made therein without departing from the invention. The scope of the invention is indicated in the appended claims and all changes that come within the meaning and range of equivalency of the claims intended to be embraced therein.

I claim:

1. An adjustable locking pliers tool comprising:

a main tool body including a brake surface, a brake handle hingedly connected to the main tool body;

a clamp handle hingedly connected to the main tool body;

a clamp jaw hingedly connected to the main tool body;

a brake jaw hingedly connected to the brake handle such that the brake jaw can rotate to effect a frictional engagement between said brake surface on the main tool body and a brake pad on the brake jaw;

an over-center linkage operating on said clamp jaw between a release position and a clamp position;

an actuating arm operably coupled to the over-center linkage to produce said release and clamp positions thereof.

2. The tool of claim 1, further including a brake-jaw spring urging the brake pad away from said brake surface on the main tool body.

3. The tool of claim 1, further including a clamp-jaw spring urging the over-center linkage toward said release position.

4. The tool of claim 1, further including an adjustment mechanism for adjusting said release position of the over-center linkage.

5. The tool of claim 4, wherein said adjustment mechanism comprises a means for varying a maximum relative rotational position between the main tool body and the clamp handle.

6. The tool of claim 1, further including a brake-handle spring urging the brake handle toward an open position.

7. The tool of claim 1, further including a release lever adapted to urge the over-center linkage toward said release position.

8. The tool of claim 1, wherein said brake surface on the main tool body and said brake pad on the brake jaw have a curved conforming geometry.

9. The tool of claim 1, wherein said actuating arm is integral with the clamp handle.

10. The tool of claim 1, wherein said over-center linkage includes a clamp link and a slotted link;

wherein a first end of the clamp link is hingedly connected to a first end of the slotted link;

wherein another end of the clamp link is hingedly connected to the clamp jaw; wherein another end of the slotted link is hingedly connected to the main tool body; and wherein said actuating arm is slidably coupled to a slot in the slotted link.

11. The tool of claim 1, wherein said actuating arm is integral with said clamp handle and forms a link in the over-center linkage.

12. The tool of claim 1, further including a brake-jaw spring urging the brake pad away from said brake surface on the main tool body; a clamp-jaw spring urging the over-center linkage toward said release position; an adjustment mechanism for adjusting said release position of the over-center linkage; a brake-handle spring urging the brake handle toward an open position; and a release lever adapted to urge the over-center linkage toward said release position;

wherein said adjustment mechanism comprises a means for varying a maximum relative rotational position between the main tool body and the clamp handle; wherein said brake surface on the main tool body and said brake pad on the brake jaw have a curved conforming geometry; said actuating arm is integral with the clamp handle; and wherein said over-center linkage includes a clamp link and a slotted link, a first end of the clamp link is hingedly connected to a first end of the slotted link, another end of the clamp link is hingedly connected to the clamp jaw, another end of the slotted link is hingedly connected to the main tool body, and said actuating arm is slidably coupled to a slot in the slotted link.

13. An adjustable locking pliers tool comprising:

a main tool body including a brake surface;

a brake handle hingedly connected to the main tool body at a first hinge point;

a clamp handle hingedly connected to the main tool body at a second hinge point;

a clamp jaw hingedly connected to the main tool body at a third hinge point;

a brake jaw hingedly connected to the brake handle at a fourth hinge point such that the brake jaw can rotate to effect a frictional engagement between said brake surface in the main tool body and a brake pad in the brake jaw;

an over-center linkage connected to the clamp jaw and operating between a release position and a clamp position;

an actuating arm operably coupled to the over-center linkage to produce said release and clamp positions thereof.

14. The tool of claim 13, wherein said first and second hinge points coincide.

15. The tool of claim 13, wherein said over-center linkage includes a clamp link and a slotted link; wherein a first end of the clamp link is hingedly connected to a first end of the slotted link; wherein another end of the clamp link is hingedly connected to the clamp jaw; wherein another end of the slotted link is hingedly connected to the main tool body at a fifth hinge point; and wherein said actuating arm is slidably coupled to a slot in the slotted link.

16. The tool of claim 15, wherein said first and second hinge points coincide.

17. The tool of claim 16, wherein said first and fifth hinge points coincide.

18. The tool of claim 13, wherein said brake surface in the main tool body and said brake pad in the brake jaw have a curved conforming geometry.

19. The tool of claim 13, further including a brake-jaw spring urging the brake pad away from said brake surface on the main tool body.

20. The tool of claim 13 further including a clamp-jaw spring urging the over-center linkage toward said release position.

* * * * *